US012392208B1

(12) United States Patent
Burkett

(10) Patent No.: US 12,392,208 B1
(45) Date of Patent: Aug. 19, 2025

(54) WELL TUBING ANCHOR AND CATCHER TOOL ASSEMBLY

(71) Applicant: PetroTool International LLC, Tyler, TX (US)

(72) Inventor: T. Ray Burkett, Tyler, TX (US)

(73) Assignee: PetroTool International LLC, Tyler, TX (US)

( * ) Notice: Subject to any disclaimer, the term of this patent is extended or adjusted under 35 U.S.C. 154(b) by 0 days.

(21) Appl. No.: 18/621,305

(22) Filed: Mar. 29, 2024

(51) Int. Cl.
*E21B 23/01* (2006.01)

(52) U.S. Cl.
CPC ..... *E21B 23/01* (2013.01)

(58) Field of Classification Search
CPC ..... E21B 23/01
See application file for complete search history.

(56) References Cited

U.S. PATENT DOCUMENTS

| | | | | |
|---|---|---|---|---|
| 2,848,563 A | | 8/1958 | Scorgie | |
| 3,002,564 A | | 10/1961 | Baker | |
| 3,077,933 A | | 2/1963 | Bigelow | |
| 3,082,831 A | | 3/1963 | Le Bus, Sr. | |
| 4,047,565 A | * | 9/1977 | Crickmer | E21B 43/10 166/217 |
| 4,601,343 A | | 7/1986 | Lindsey, Jr. et al. | |
| 4,688,642 A | | 8/1987 | Baker | |
| 4,926,936 A | * | 5/1990 | Braddick | E21B 23/042 166/216 |

(Continued)

FOREIGN PATENT DOCUMENTS

| | | | |
|---|---|---|---|
| CA | 2848563 A1 * | 10/2014 | E21B 17/1035 |
| CA | 2854409 A1 | 12/2015 | |

(Continued)

OTHER PUBLICATIONS

Innovex Lockdown Anchor Catcher product sheet, listed revision date Sep. 2021, pp. 1.

(Continued)

*Primary Examiner* — James G Sayre
(74) *Attorney, Agent, or Firm* — Grady K. Bergen; Griggs Bergen LLP

(57) ABSTRACT

A tool assembly for anchoring and/or catching well equipment within a well casing utilizes a mandrel that carries a pair of cones and a control body that surrounds the mandrel and carries a pair of slip assemblies configured to engage the well casing. The control body has a set of interconnected slots that are configured to receive a control pin of the mandrel. The control pin travels within the set of interconnected slots that comprise a run slot that limits the distance the control pin and mandrel travel so that the tool assembly is maintained in a released condition wherein the slip assemblies are disengaged from the cones. The interconnected slots further comprising a set slot that is spaced circumferentially apart from the run slot and has a length that allows the control pin of the mandrel to travel further so that the cones can engage the slip assemblies to thereby anchor or catch the tool assembly within the well casing. The run slot and set slot being joined together by a slot passage that allows the control pin to move between the run slot and the set slot when the mandrel is rotated about a central longitudinal axis.

20 Claims, 17 Drawing Sheets

(56) References Cited

U.S. PATENT DOCUMENTS

| | | | | |
|---|---|---|---|---|
| 5,327,975 | A * | 7/1994 | Land | E21B 33/0415 166/216 |
| 7,255,172 | B2 | 8/2007 | Johnson | |
| 9,051,812 | B2 | 6/2015 | Clemens et al. | |
| 9,169,703 | B2 | 10/2015 | Larsen et al. | |
| 12,031,411 | B1 | 7/2024 | Clark et al. | |
| 12,152,451 | B2 | 11/2024 | Stachowiak, Jr. | |
| 2004/0112591 | A1 | 6/2004 | Wright et al. | |
| 2014/0262343 | A1 | 9/2014 | Larsen et al. | |
| 2015/0322740 | A1 | 11/2015 | Marshala et al. | |
| 2023/0121136 | A1 | 4/2023 | Hult et al. | |

FOREIGN PATENT DOCUMENTS

| | | | |
|---|---|---|---|
| CA | 2890533 | C | 11/2017 |
| CN | 209011795 | U | 6/2019 |
| GB | 2309470 | A | 7/1997 |
| JP | 2004209589 | A | 7/2004 |
| RU | 2654088 | C1 | 5/2018 |

OTHER PUBLICATIONS

Office Action mailed May 21, 2025 in related U.S. Appl. No. 18/817,963, and listed of cited references, pp. 1-21.

International Search Report and Written Opinion dated Jun. 10, 2025 in counterpart International PCT Patent Application No. PCT/US2025/021952, pp. 1-26.

* cited by examiner

WELL TUBING ANCHOR AND CATCHER TOOL ASSEMBLY

TECHNICAL FIELD

The invention relates to those tools used for anchoring and/or catching well equipment, such as tubing strings, within a well casing.

BACKGROUND

Tubing anchor and catcher tools have been widely used in the oil and gas industry to secure tubing strings and well equipment within well casings. The designs of these tools have not changed significantly over many years. An example of a conventional tubing anchor/catcher is that described in U.S. Pat. No. 3,077,933. These tools utilize helical threaded portions on the tool and are actuated by rotational movement to anchor or release the tool and tubing within the casing. Typically, rotation of the tool to the left or counterclockwise causes the tool to be set, while rotation of the tool to the right or clockwise causes the tool to be released. Multiple rotations of the tubing string and tool may be required before the tool is set or released.

Problems with these types of tools, however, are often encountered. The threaded portions of the tool are prone to damage, such as through corrosion or other physical damage to the threads. Seizing of the threaded portions is not uncommon so that the full number of rotations cannot be achieved, preventing the tool from being either set or released. Additionally, applying excessive rotational force to the tool to achieve the required number of turns can result in the tool, the connection between the tubing and tool, or even the tubing itself to break.

Accordingly, there is a need for improved tubing and anchor tools that overcome these and other problems and improve operational efficiency of the tool.

BRIEF DESCRIPTION OF THE DRAWINGS

For a more complete understanding of the embodiments described herein, and the advantages thereof, reference is now made to the following descriptions taken in conjunction with the accompanying figures, in which.

DETAILED DESCRIPTION

Figure 1:
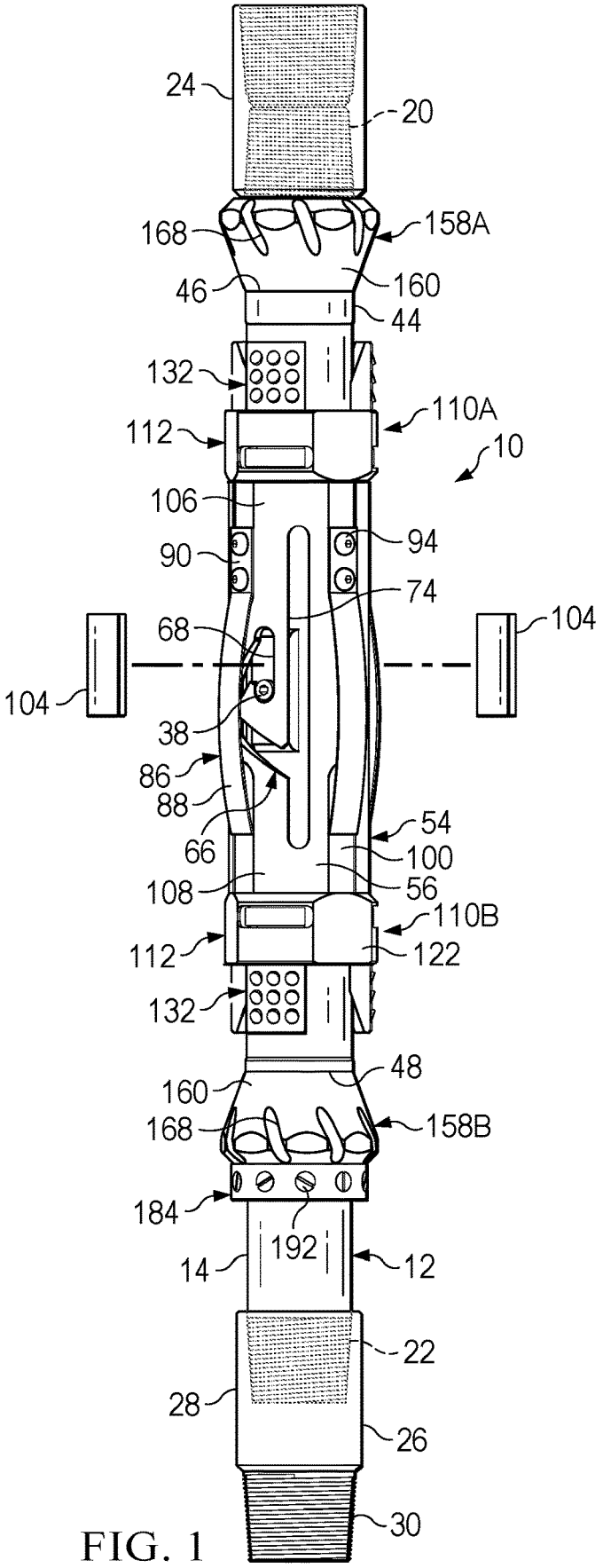
FIG. 1 is a front elevational view of a tool assembly for anchoring and catching well equipment within a well casing, and constructed in accordance with a particular embodiment.

Referring to FIG. 1, a tool assembly 10 for anchoring and/or catching tubing and other well equipment within a well casing is shown. The materials of the tool assembly 10 and its various components may be formed from various strong, durable metal materials, such as high-strength steel or steel alloys. In many instances, all or portions of the surfaces of these materials used for the various components of the tool assembly 10 may be treated or coated, such as with a zinc-phosphate coating, to reduce or prevent wear resistance and corrosion in those fluids (e.g., salt water, brine, etc.) and harsh conditions that are often encountered in oil and gas wells.

Figure 2:
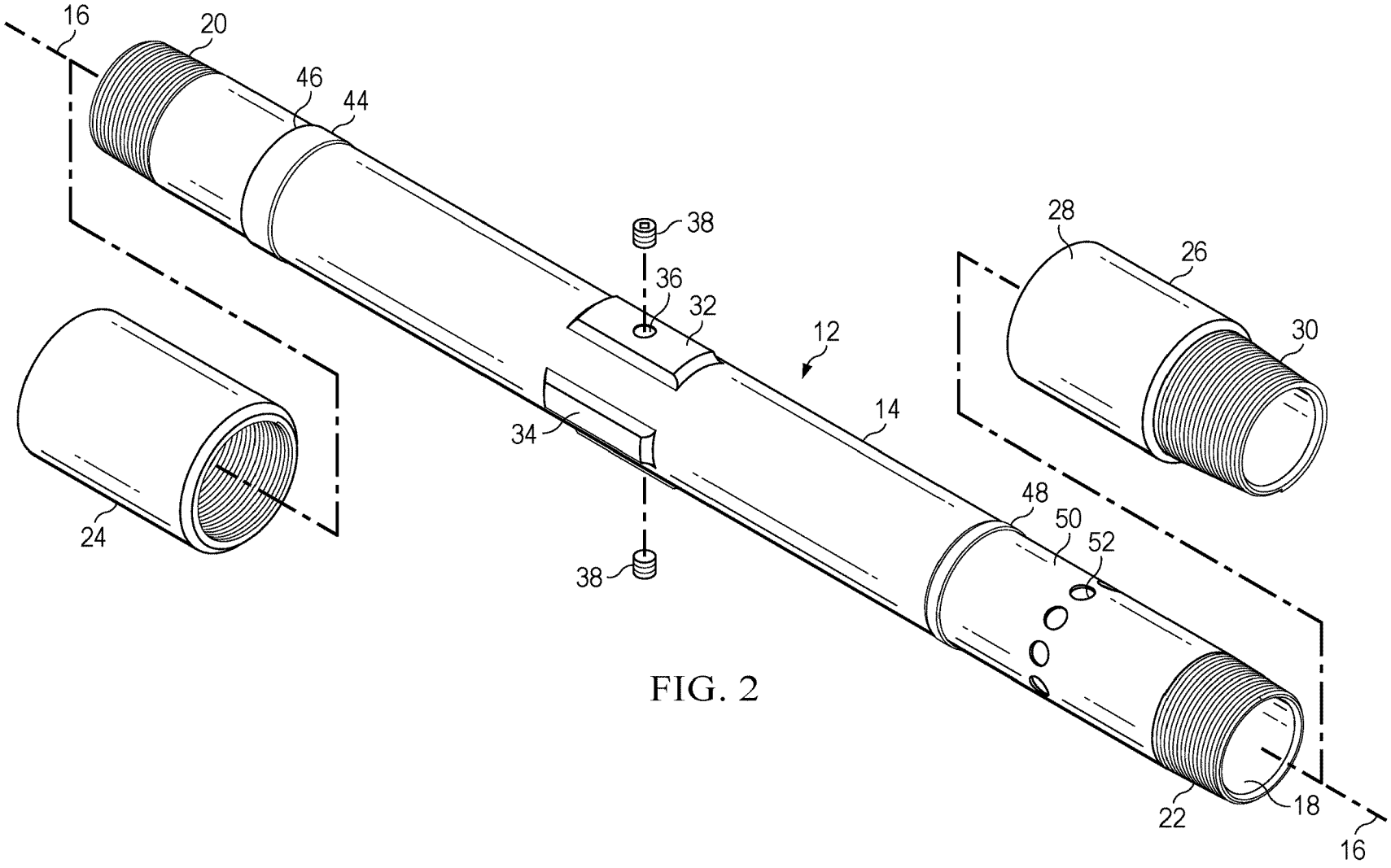
FIG. 2 is a perspective view of a mandrel of the tool assembly of FIG. 1, shown with upper and lower tubing couplings exploded away from the mandrel.

The tool assembly 10 comprises a mandrel 12, as shown in FIG. 2. The mandrel 12 is configured as an elongated, cylindrical body formed by a cylindrical mandrel wall 14 that surrounds a central longitudinal axis 16. The mandrel wall 14 defines a hollow interior or central flow passage 18 of the mandrel 12. The central passage 18 may have a uniform diameter along all or a portion of the length of the mandrel 12.

In many embodiments, the flow passage 18 may have a uniform diameter along its entire length that matches or is within certain tolerances of the inner diameter of the well tubing with which it is used. For example, commonly used well tubing has an inner diameter of 2.30 inches. Thus, the inner diameter of the central flow passage 18 mandrel 12 may be configured to have an inner diameter of 2.30 inches, as well. The inner diameter of the central flow passage 18 may be within ±0.50% or less of that of the inner diameter of the tubing with which the mandrel 12 is used. In certain embodiments, the inner diameter of the central flow passage 18 may be within a tolerance of from at least, equal to, and/or between any two of ±0.01%, ±0.05%, ±0.10%, ±0.15%, ±0.20%, ±0.25%, ±0.30%, ±0.35%, ±0.40%, ±0.45%, and ±0.50% of that of the inner diameter of the tubing string with which the mandrel 12 is used.

It should be noted in the description, if a numerical value or range is presented, each numerical value should be read once as modified by the term "about" (unless already expressly so modified), and then read again as not so modified unless otherwise indicated in context. Also, in the description, it should be understood that an amount range listed or described as being useful, suitable, or the like, is intended that any and every value within the range, including the end points, is to be considered as having been stated. For example, "a range of from 1 to 10" is to be read as indicating each and every possible number along the continuum between about 1 and about 10. Thus, even if specific points within the range, or even no point within the range, are explicitly identified or referred to, it is to be understood that the inventors appreciate and understand that any and all points within the range are to be considered to have been specified, and that inventors possess the entire range and all points within the range.

Upper and lower ends 20, 22 of the mandrel 12 are externally threaded for coupling to top and bottom couplings 24, 26, respectively. As used herein, unless stated otherwise or is apparent from its context, the expressions "upper," "top", "up," "upward," "above," "bottom," "lower," "down," "downward," "below" and similar expressions are used for convenience and refer to the orientation of the tool assembly 10, as shown in FIG. 1 and as it would be positioned within a well casing, with "upper," "top", "up," "upward", "above," etc., referring to that position or direction within the well casing that is closer to or in a direction through the well casing towards the wellhead or surface, while "bottom," "lower," "down," "downward," "below," etc., refer to that position or direction through the well casing that is further from or in a direction away from the wellhead.

The top coupling 24 may be internally threaded at both ends for coupling at one end to the externally threaded upper end 20 of the mandrel 12 and at the other end to externally threaded tubing or other well equipment that extends from the wellhead. The bottom coupling 26 may be internally threaded at an upper end 28 for coupling to the externally threaded lower end 22 of the mandrel 12. The lower end 30 of the bottom coupling 26 may be externally threaded and configured to couple to internal threads of tubing or other well equipment. In other embodiments, the ends 20, 22 of the mandrel 12 and/or the couplings 24, 26 may be configured differently to facilitate coupling to other tubing, well equipment or other couplings. The upper end 28 of bottom coupling 26 is shown configured as a female end and is internally threaded for receiving the threaded lower end 22 of the mandrel 12.

Figure 3:
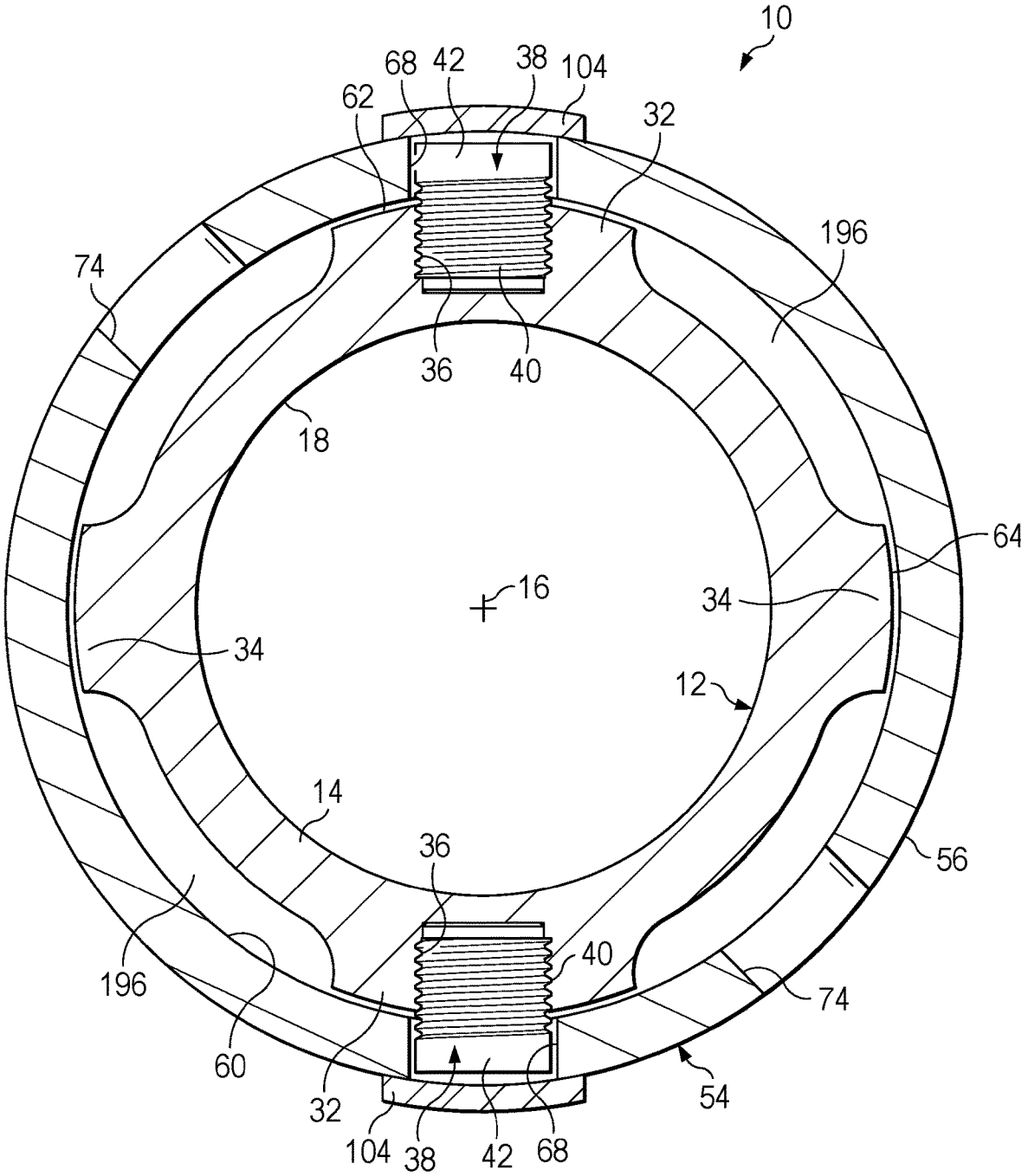
FIG. 3 is a transverse cross-sectional view of the mandrel of FIG. 2, shown with a control body surrounding the mandrel and control pins positioned within run slots of the control body.

Provided on the exterior of the mandrel wall 14 at or near the center of the mandrel 12 are raised or projecting areas 32, 34 that project from the mandrel wall 14. The raised areas 32, 34 may have an overall rectangular perimeter, with the length of the areas 32, 34 being parallel with the longitudinal axis 16. Each of the raised areas 32, 34 has a transverse arcuate convex exterior surface, as shown in FIG. 3. The arcuate convex exterior surfaces of the raised areas 32, 34 may have a constant radius of curvature along their lengths, with the radius of curvature being a line that extends perpendicularly from the longitudinal axis 16 to the exterior surfaces of the raised areas 32, 34. The raised areas 32, 34 are circumferentially spaced approximately 900 apart from one another on the mandrel wall 14. One or more or all of the raised areas 32, 34 may be provided with an internally helically threaded control pin port 36. In the embodiment shown, only the two raised areas 32 that are spaced at or approximately 180° apart on the mandrel wall 14 are provided with the control pin port 36, while the raised areas 34 that are located between the raised areas 32 and are also spaced 180° do not have any such ports.

The control pin ports 36 of raised areas 32 are each configured to receive a control pin 38. Each control pin 38 has a threaded inner end portion 40 that is received and threads into one of the threaded ports 36. The outer end 42 of the control pin 38 projects radially outward from the ports 36 and raised areas 32, as shown in FIG. 3. The outer end 42 of the control pin 38 may be free of threads and have short cylindrical configuration with a generally uniform circular transverse cross section along all or a portion of its height.

An annular band or collar 44 near the upper end 20 of the mandrel 12 projects radially outward from the mandrel wall 14 and is spaced longitudinally on the mandrel wall 14 above the raised portions 32, 34 to form an upper annular shoulder 46 on the mandrel 12. A lower annular shoulder 48 is provided near the lower end 22 of the mandrel 12 and is located longitudinally below the raised portions 32, 34. The lower annular shoulder 48 may be formed by a stepped-down portion 46 of the mandrel wall 14 having a smaller outer diameter than that above the shoulder 48. The stepped-down portion 46 may have a generally uniform diameter along its length extending towards the lower end 22 of the mandrel 12.

As shown in FIG. 2, a series of circumferentially-spaced apart apertures or ports 52 are formed in the stepped-down portion 46 of the mandrel wall 14. The apertures or ports 52 may be equally spaced apart about the circumference of the mandrel wall 14 and are non-threaded for receiving the ends of shear screws of a shear ring, as discussed later.

Figure 4:
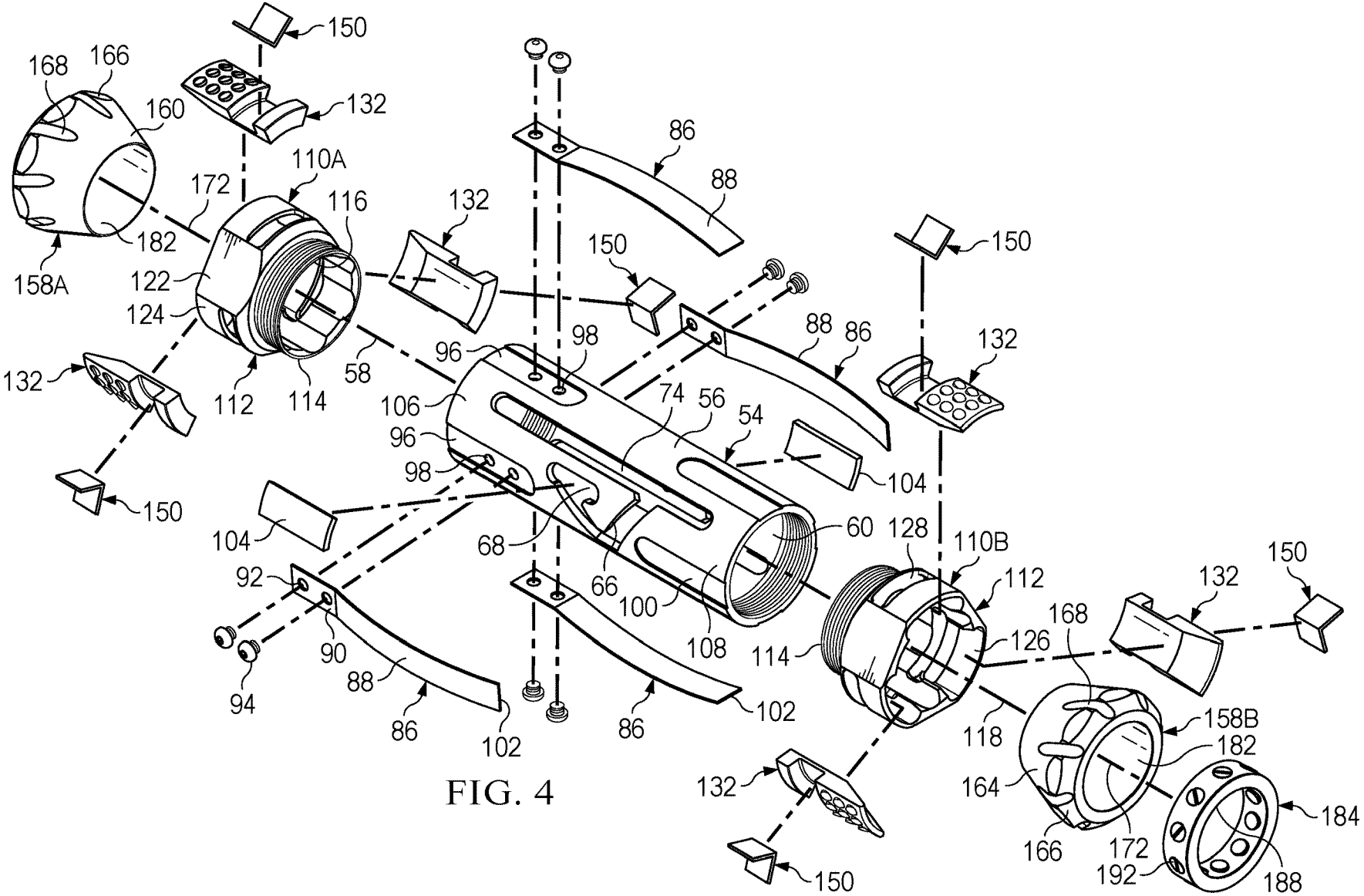
FIG. 4 is a perspective view of the control body, slip assemblies, cones and other various components of the tool assembly of FIG. 1, shown exploded away.

Referring to FIG. 4, various components of the tool assembly 10 that are configured to be mounted over the mandrel 12 are shown. A control body 54 of the tool assembly 10 comprises a cylindrical control body wall 56 that surrounds a central longitudinal axis 58 of the control body 54. The control body wall 56 is configured as a sleeve that defines an interior central cylindrical passage 60 that surrounds the axis 58 and extends the length of the control body 54. The control body 54 is mounted over the mandrel 12, with the mandrel 12 being received within the central opening 60 of the control body 54. When the control body 54 is mounted on the mandrel 12, the axis 58 of the control body 54 is concentric with the central axis 16 of the mandrel 12. The mandrel 12 is movable relative to the control body 54 both longitudinally and rotationally about the central axes 16, 58 relative to the control body 12. As shown in FIG. 3, the raised areas 32, 34 of mandrel 12 facilitate centering of the control body 54 on the mandrel.

The central opening 60 of the control body 54 is sized and configured to accommodate the raised areas 32, 34 so that they are also spaced from the interior of the control body wall 56 to provide small clearances 62, 64, respectively. The raised areas 32, 34 facilitate centering the control body on the mandrel 12, with the clearances 62, 64, allowing the mandrel 12 and control body 54 to rotate relative to one another around their concentric axes 16, 58.

The control body 54 comprises a right-hand (RH) set/right-hand (RH) release control body so that the tool assembly 10 employing the control body 54 functions as a RH set/RH release tool assembly. As will be described later, differently configured control bodies can alter the direction of setting and releasing of the tool assembly 10.

Formed in the control body wall 56 are a set of interconnected slots 66 that extend through all or a portion of the thickness of the control body wall 56 from the interior surface of the wall 56. In the embodiment shown, all or some of the interconnected set of slots 66 extend through the entire thickness of the wall 56 so that the slots 66 form open areas in the control body wall 56. In other embodiments, however, all or some of the slots may extend only partially through the entire thickness of the control body wall 56 from the interior of the control body wall 56. When the control body 54 is mounted over the mandrel 12, the interconnected slots 66 receive the outer end 42 of the control pin 38 that projects from the raised areas 32 of the mandrel wall 14. The slots 66 are sized and configured to allow the control pin 38 to travel within the slots 66 as the mandrel 12 is moved relative to the control body 54.

In the embodiment shown, there are two sets of interconnected slots 66 that each have the same configuration but are each positioned 180° apart on opposite sides of the control body wall 56. As can be seen more readily in the embodiment of FIG. 3, when the control pin 38 is received within the slots 66, the outer end 42 of the control pin 38 remains at or is flush with the edges of the slots 66 or is otherwise recessed or spaced radially inward from the exterior edges of the slots 66 so that the control pin 38 does not project beyond the exterior surface of the control body wall 56. In other embodiments, the control pin 38 may project radially outward a distance from the exterior surface of the control body wall 56 through the interconnected slots 66.

Each set of interconnected slots 66 comprises a run slot 68 provided at a first circumferential position on the control body wall 56. The run slot 68 has a generally linear configuration and extends longitudinally along the wall 56. The opposite upper and lower ends 70, 72, respectively, of the slot 68 may be concavely curved or arcuate to accommodate and receive the circular outer end 42 of the control pin 38 when it abuts against the ends of the slot 68. The center of the run slot 68 may be positioned at or near the center or midpoint of the control body 54 and has a width that accommodates the diameter of the control pin 38 so that the control pin 38 can freely move along the length of the slot 68. The run slot 68 is positioned on the control body wall 56 and has a longitudinal length that limits the distance the control pin 38 and mandrel 12 can travel longitudinally relative to the control body 54. This ensures that the tool assembly 10 is maintained in a released condition when the control pin 38 is located within the run slot 68.

While not to be limited necessarily to any particular dimensions, in certain embodiments, the run slot 68 may have an overall longitudinal length of from 1 inch to 5 inches. In certain embodiments the run slot 68 may have an overall longitudinal length of from at least, equal to, and/or between any two of 1 inch, 1.1 inches, 1.2 inches, 1.3 inches, 1.4 inches, 1.5 inches, 1.6 inches, 1.7 inches, 1.8 inches, 1.9 inches, 2.0 inches, 2.1 inches, 2.2 inches, 2.3 inches, 2.4 inches, 2.5 inches, 2.6 inches, 2.7 inches, 2.8 inches, 2.9 inches, 3.0 inches, 3.1 inches, 3.2 inches, 3.3 inches, 3.4 inches, 3.5 inches, 3.6 inches, 3.7 inches, 3.8 inches, 3.9 inches, and 4.0 inches, 4.1 inches, 4.2 inches, 4.3 inches, 4.4 inches, 4.5 inches, 4.6 inches, 4.7 inches, 4.8 inches, 4.9 inches, and 5.0 inches.

Each set of interconnected slots 66 further comprises a set slot 74 provided on the control body wall 56 that is circumferentially spaced apart from the run slot 68. The set slot 74 has a generally linear configuration and extends longitudinally along the wall 56 and is parallel with the run slot 68. The opposite upper and lower ends 76, 78, respectively, of the set slot 74 may also be concavely curved or arcuate. In most instances the set slot 74 has a sufficient length so that during use of the tool assembly 10 the control pin 38 will not travel the full length or engage the ends 76, 78 of the set slot 74. The set slot 74 may also be positioned with its center at or near the center or midpoint of the control body 54 so that the centers of each of the run slot 68 and set slot 74 may be at or near the same longitudinal position on the control body wall 56.

Figure 5:
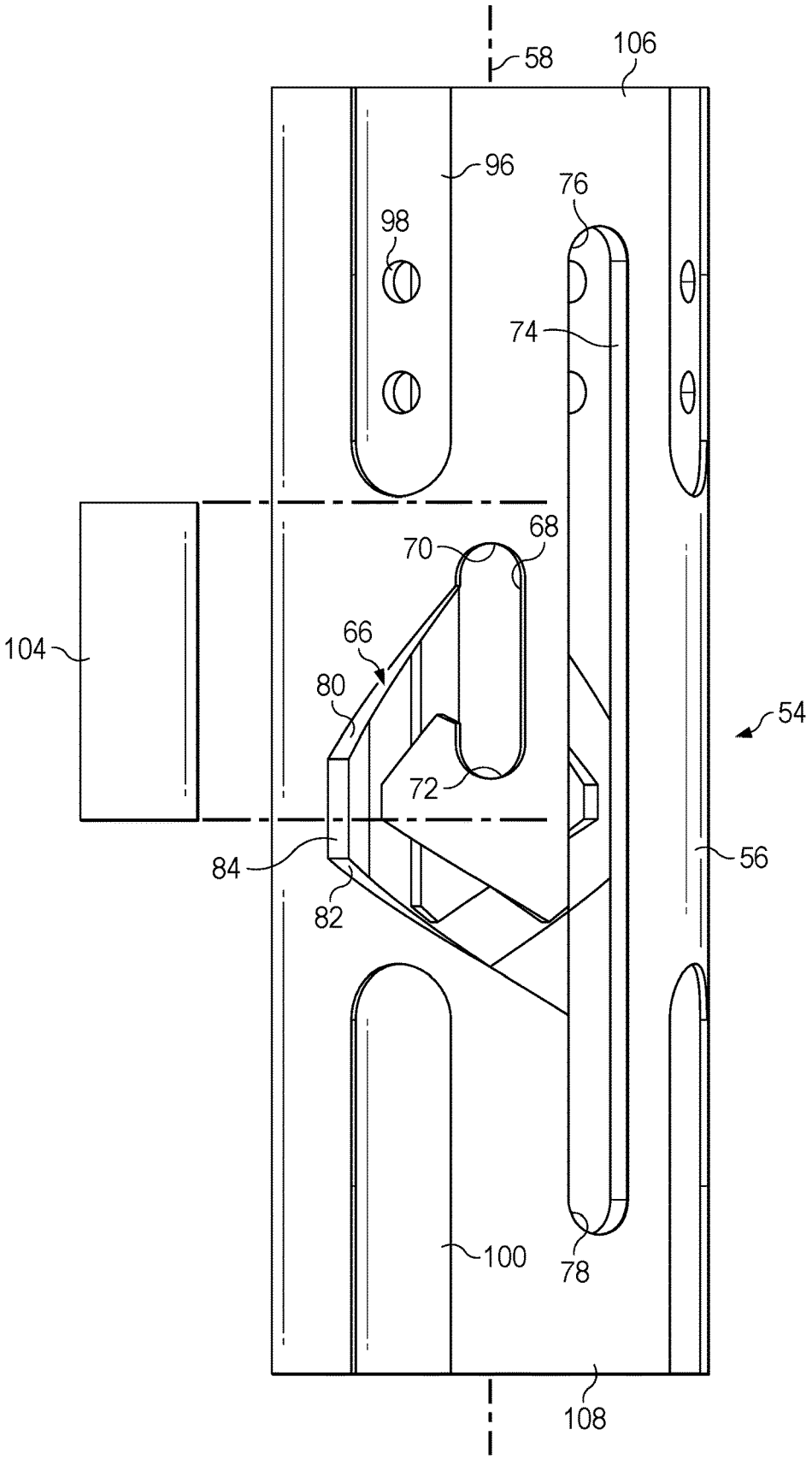
FIG. 5 is an enlarged front elevational view of the control body of the tool assembly of FIG. 1.

As can be seen in FIG. 5, the set slot 74 has a longitudinal length that is longer than that of the run slot 68, with the upper and lower halves of the set slot 74 extending longitudinally beyond the ends 70, 72 of the run slot 68 on the control body wall 56. The set slot 74 may have a width that accommodates the diameter of the control pin 38 to allow it to freely move longitudinally within the slot 74 while limiting lateral or circumferential movement of the control pin 38 within the slot 74 as it is moved towards the ends 76, 78 of the slot 74. The set slot 74 is positioned on the control body wall 56 and has a longitudinal length that allows the control pin 38 and mandrel 12 to travel longitudinally relative to the control body 54 so that the tool assembly 10 can be moved to a set condition where the tool assembly 10 is in an anchored or caught condition within the well casing with which it is used.

While not to be necessarily limited to any particular dimensions, in certain embodiments, the set slot 74 may have an overall longitudinal length of from 5 inches to 12 inches or more. In certain embodiments the run slot 68 may have an overall longitudinal length of from at least, equal to, and/or between any two of 5.0 inches, 5.1 inches, 5.2 inches, 5.3 inches, 5.4 inches, 5.5 inches, 5.6 inches, 5.7 inches, 5.8 inches, 5.9 inches, 6.0 inches, 6.1 inches, 6.2 inches, 6.3 inches, 6.4 inches, 6.5 inches, 6.6 inches, 6.7 inches, 6.8 inches, 6.9 inches, 7.0 inches, 7.1 inches, 7.2 inches, 7.3 inches, 7.4 inches, 7.5 inches, 7.6 inches, 7.7 inches, 7.8 inches, 7.9 inches, 8.0 inches, 8.1 inches, 8.2 inches, 8.3 inches, 8.4 inches, 8.5 inches, 8.6 inches, 8.7 inches, 8.8 inches, 8.9 inches, 9.0 inches, 9.1 inches, 9.2 inches, 9.3 inches, 9.4 inches, 9.5 inches, 9.6 inches, 9.7 inches, 9.8 inches, 9.9 inches, 10.0 inches, 10.1 inches, 10.2 inches, 10.3 inches, 10.4 inches, 10.5 inches, 10.6 inches, 10.7 inches, 10.8 inches, 10.9 inches, 11.0 inches, 11.1 inches, 11.2 inches, 11.3 inches, 11.4 inches, 11.5 inches, 11.6 inches, 11.7 inches, 11.8 inches, 11.9 inches, and 12.0 inches.

The run slot 68 and set slot 74 of each set of interconnected slots 66 are circumferentially spaced apart from 900 or less on the control body wall 56, as measured from a center line of each slot 68, 74. In certain embodiments, the run slot 68 and set slot 74 of each set of interconnected slots 66 are circumferentially spaced apart less than 90°, 85°, 80°, 75°, 70°, 65°, 60°, 55°, 50°, 45°, 40°, 35°, 30°, 25°, 20°, 15°, 100 or less, as measured from a center line of each slot. In certain embodiments run slot 68 and set slot 74 of each set of interconnected slots 66 are circumferentially spaced apart from one another from at least, equal to, and/or between any two of 10°, 11°, 12°, 13°, 14°, 15°, 16°, 17°, 18°, 19°, 20°, 21°, 22°, 23°, 24°, 25°, 26°, 27°, 28°, 29°, 30°, 31°, 32°, 33°, 34°, 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, 60°, 61°, 62°, 63°, 64°, 65°, 66°, 67°, 68°, 69°, 70°, 71°, 72°, 73°, 74°, 75°, 76°, 77°, 78°, 79°, 80°, 81°, 82°, 83°, 84°, 85°, 86°, 87°, 88°, 89°, and 90°, as measured from the center line of each slot 68, 74.

The run slot 68 and set slot 74 are interconnected by upper and lower passage slots 80, 82 of the set of interconnected slots 66. As viewed in FIG. 5, the upper passage slot 80 opens into and extends from the left side of run slot 68. The upper passage slot 80 is angled downward from the run slot 68 towards the left, or the direction away from both the run slot 68 and set slot 74, where it is joined at its lower end to an upper end of a short longitudinally oriented transition slot 84. In certain embodiments, the upper passage slot 80 may be oriented downward to the left from the run slot 68 at an angle of from 30° to 60°, more particularly from 40° to 50°, relative to the longitudinal axis 58 of the control body 54. In particular embodiments, the upper passage slot 80 may be oriented at an angle of from at least, equal to, and/or between any two of 30°, 31°, 32°, 33°, 34°, 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, and 70°, relative to the longitudinal axis 58 of the control body 54.

The lower passage slot 82 is joined at its upper end to the lower end of the transition slot 84, extending downward at an angle to the right, as viewed in FIG. 5, towards the set slot 74. The lower end of the lower passage slot 80 opens into the left side of the set slot 74 at a longitudinal position below the lower end 72 of the run slot 68, as is shown. The lower passage slot 82 is oriented downward to the right from the transition slot 84 or lower end of the upper passage slot 80. In certain embodiments, the lower passage slot 82 may be oriented downward to the right at an angle of from 30° to 60°, more particularly from 40° to 50°, relative to the longitudinal axis 58 of the control body 54. In particular embodiments, the upper passage slot 80 may be oriented at an angle of from at least, equal to, and/or between any two of 30°, 31°, 32°, 33°, 34°, 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, and 70°, relative to the longitudinal axis 58 of the control body 54.

As can be seen in FIG. 5, the transition slot 84 is situated at the greatest circumferential distance from the set slot 74. The transition slot 84 forms a corner where the upper passage slot 80 and lower passage slot 82 come together or meet. In some embodiments, the transition slot 84 may merely be the junction or corner where the lower end of the upper passage slot 80 and the upper end of the lower passage slot 82 are joined directly together. In such instances, the corner formed where the two passage slots 80, 82 are joined should be configured to provide sufficient room or clearance for the control pin 38 to transition and pass between the upper passage slot 80 and the lower passage slot 82.

In certain embodiments, the transition slot 84 of each set of interconnected slots 66 is circumferentially spaced apart from the run slot 68 and/or set slot 74 no further than 90°, 85°, 80°, 75°, 70°, 65°, 60°, 55°, 50°, 45°, 40°, 35°, 30°, 25°, 20°, 15°, 100 or less, as measured from the center of each slot. In this configuration, the run slot 68 is positioned circumferentially closer to the transition slot 84 than the set slot 74. In certain embodiments, the transition slot 84 and run slot 68 and/or set slot 74 of each set of interconnected slots 66 are circumferentially spaced apart from one another from at least, equal to, and/or between any two of 10°, 11°, 12°, 13°, 14°, 15°, 16°, 17°, 18°, 19°, 20°, 21°, 22°, 23°, 24°, 25°, 26°, 27°, 28°, 29°, 30°, 31°, 32°, 33°, 34°, 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, 60°, 61°, 62°, 63°, 64°, 65°, 66°, 67°, 68°, 69°, 70°, 71°, 72°, 73°, 74°, 75°, 76°, 77°, 78°, 79°, 80°, 81°, 82°, 83°, 84°, 85°, 86°, 87°, 88°, 89°, and 90°, as measured from the center of each slot 84 and 68 and/or 74. In the embodiment shown, the transition slot 84 is circumferentially spaced approximately 350 from the run slot 68 and approximately 650 from the set slot 74. And the run slot 68 is circumferentially spaced from the set slot 74 approximately 30°. Thus, in the embodiment shown, the total amount of rotation of the tubing string and mandrel 12 relative to the control body 54 encountered in moving the control pin 38 from the run slot 68 to the transition slot is only 35°. And the rotation in moving the control pin 38 from the transition slot 84 to the set slot 74 is only 65°.

The longitudinal position of the lower end of the lower passage slot 82 where it opens into and meets the set slot 74 should be at a location on the set slot 74 where the control pin 38 and mandrel 12 are still at a position where the tool assembly 10 is maintained in a released condition or at a position where tool assembly 10 just enters into a set condition.

Referring to FIG. 4, two or more control springs 86 are provided with the control body 54. In the embodiment shown, there are four control springs 86 circumferentially spaced apart an equal distance on the exterior of the control body 54. The control springs 86 may each comprise an elongated leaf spring body 88 that bows radially outward and an attachment flange or extension 90 that is joined to the leaf spring body 88 at one end. The attachment flange or extension 90 is formed as a rectangular body having a pair of apertures 92 for receiving threaded screws or fasteners 94. A surface groove or channel 96 may be formed in the exterior surface of the control body 54 at its upper end and be sized and configured to receive the flange or extension 90 of the control spring 86. A pair of threaded apertures 98 of the groove 96 that align with the apertures 92 of the flange or extension 90 extend from the groove 96 into the control body wall 56 to receive the ends of the screws or fasteners 94 to secure the control springs 86 to the control body 54.

A longitudinal surface groove or channel 100 is formed in the exterior surface of the control body wall 56 below the attachment groove or channel 96. In the embodiment shown, when control spring 86 is mounted to the control body 54 through the attachment flange or extension 90, the leaf spring body 88 extends longitudinally downward along the side of the control body 54, with a lower end 102 of the leaf spring body 88 being received within the groove or channel 100. The groove or channel 100 is sized and configured to allow the spring 86 to flex, with the lower end 102 of the leaf spring body 88 being able to slide longitudinally within the groove or channel 100 relative to the control body 54 during radial compression or expansion of the bowed leaf spring body 88, while restricting circumferential or lateral movement of the lower end 102 of the leaf spring body 88.

In some embodiments, one or more reinforcement plates 104 is provided with the control body 54. In the embodiment shown, the reinforcement plate 104 is secured over the run slot 68 to reinforce the edges and ends 76, 78 of the slot 68 where large forces may be encountered when contacted by the control pin 38 on the ends 76, 78 of the slot 68 during run and retrieval of the tool assembly 10. As can be seen in FIG. 3, the reinforcement plate 104 may have a curved transverse cross section along all or a portion of its length to accommodate the curvature of the control body wall 56. The reinforcement plate 104 may be welded to the exterior of the control body wall 56. In other instances, thickened areas of the control body wall 56 surrounding the run slot 68, such as may be formed during the machining of the control body 54, may provide reinforcement. If necessary, other areas of the interconnected slots 66 may be similarly reinforced.

As shown in FIG. 4, the central opening 60 at both upper and lower ends 106, 108, respectively, of the control body 54 has threads formed on the interior of the control body wall 56 for coupling to a pair of slip assemblies 110A, 110B. For ease of description, the slip assemblies 110A, 110B, are collectively referred to with the reference numeral 110, but are individually referred to with the reference numerals 110A, 110B. As viewed in FIG. 1, the slip assembly 110A constitutes an upper or catcher slip assembly and the slip assembly 110B constitutes a lower or anchor slip assembly.

Figure 6:
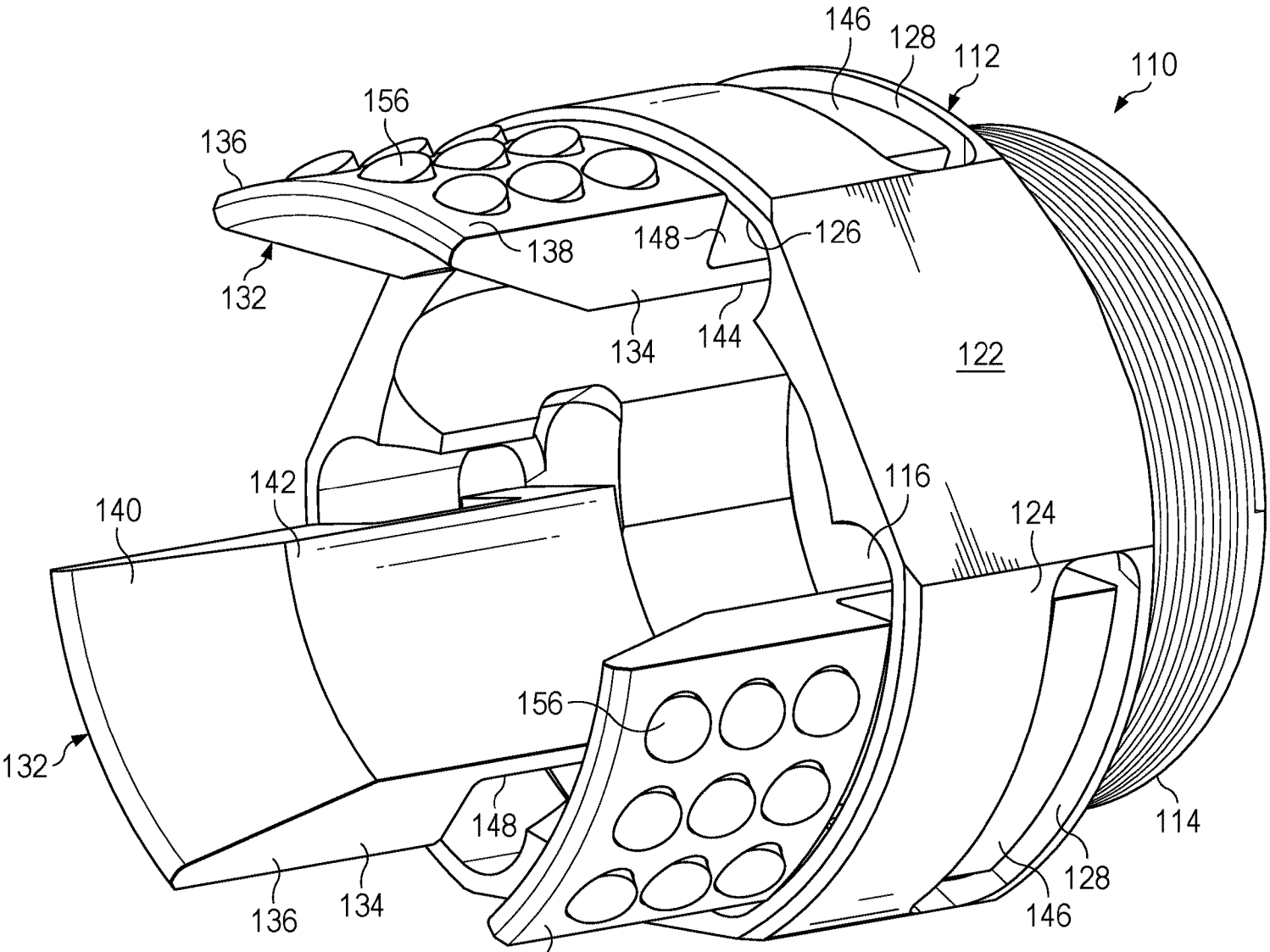
FIG. 6 is a perspective view of a slip assembly of the tool assembly of FIG. 1.
Figure 7:
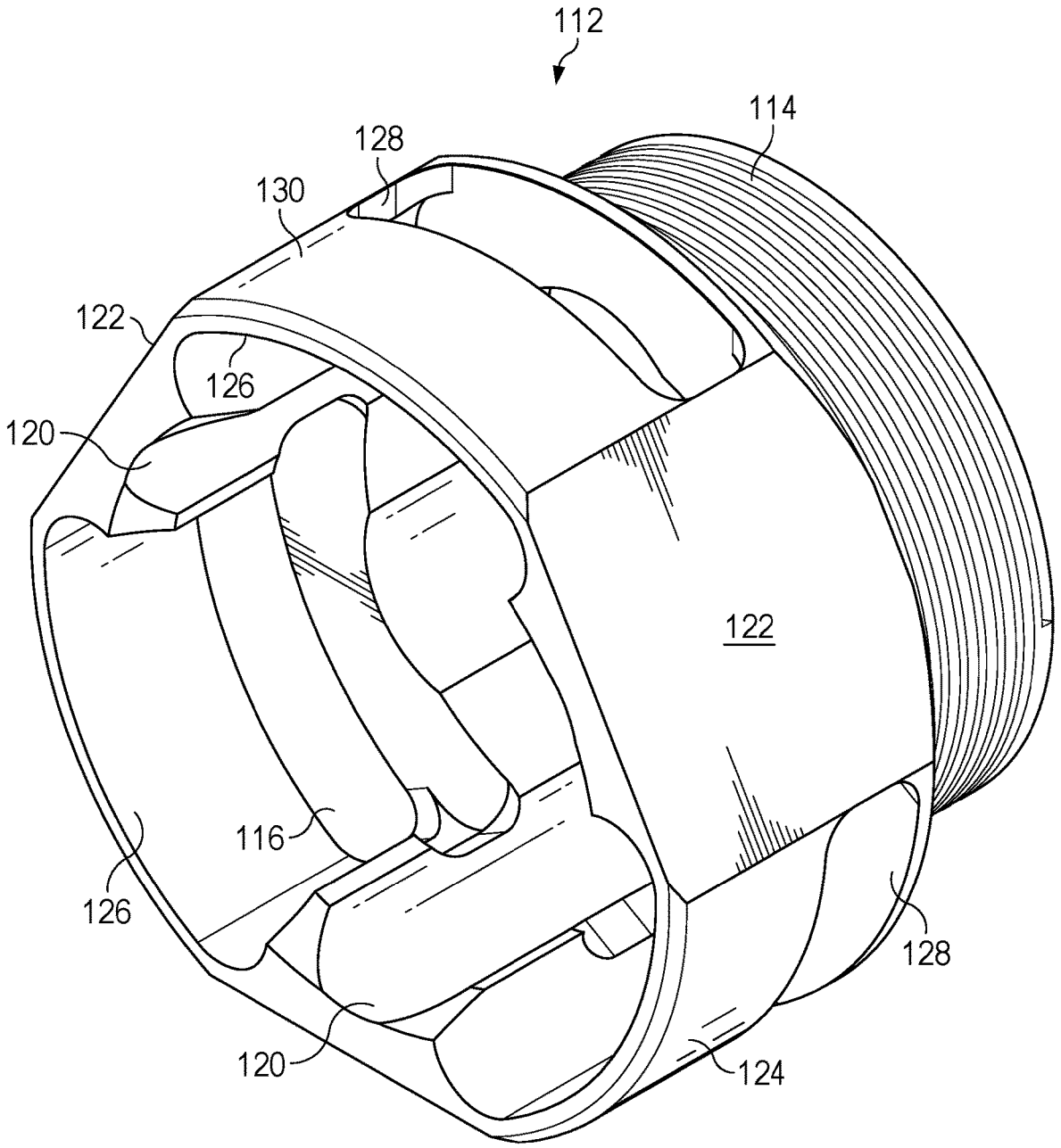
FIG. 7 is a perspective view of a slip housing of the slip assembly of FIG. 6.

A more detailed view of the slip assembly 110 is shown in FIG. 6. Each slip assembly 110 comprises a slip housing 112, shown in detail in FIGS. 7-9. As shown, the slip housing 112 has an externally threaded end portion 114 that is configured to screw into the internally threaded ends 106, 108 of the control body 54 to couple the housing 112 to the control body 54.

An interior central bore 116 of the housing 112 surrounds a central longitudinal axis 118 that extends along the length of the housing 112. The central bore 116 is configured to position over and receive the mandrel 12 when the housing 112 is coupled to the control body 54. When coupled, the central axis 118 of the housing 112 may be concentric with the central longitudinal axes 16, 58 of the mandrel 12 and control body 54, respectively.

Figure 8:
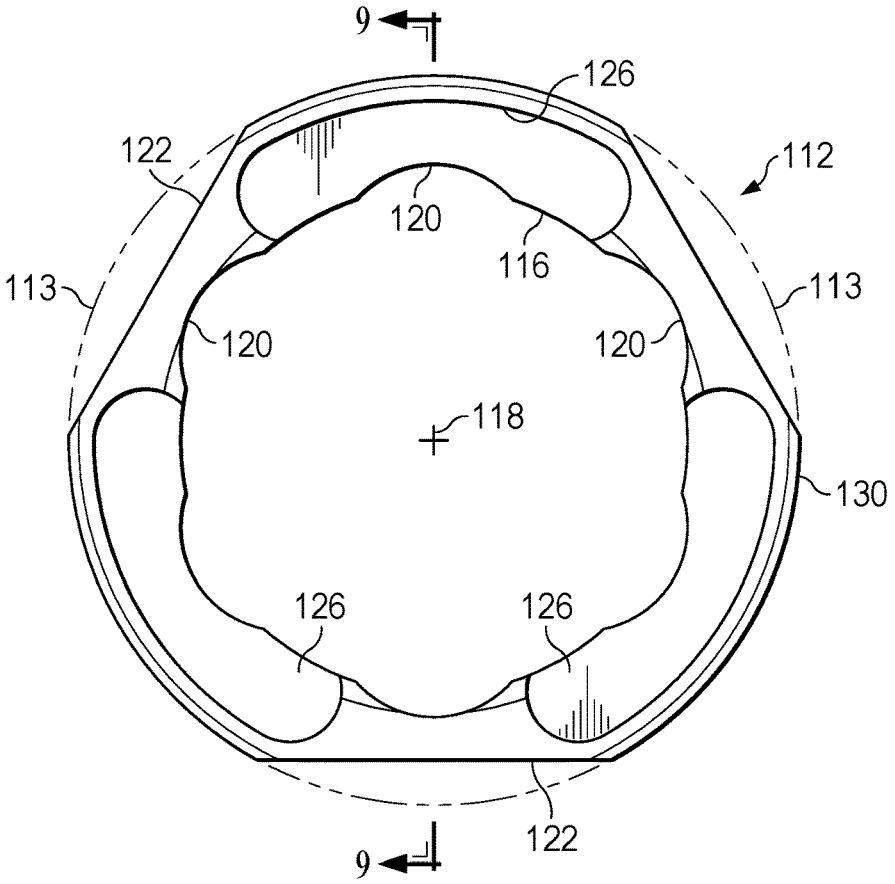
FIG. 8 is a top plan view of the slip housing of FIG. 7.
Figure 9:
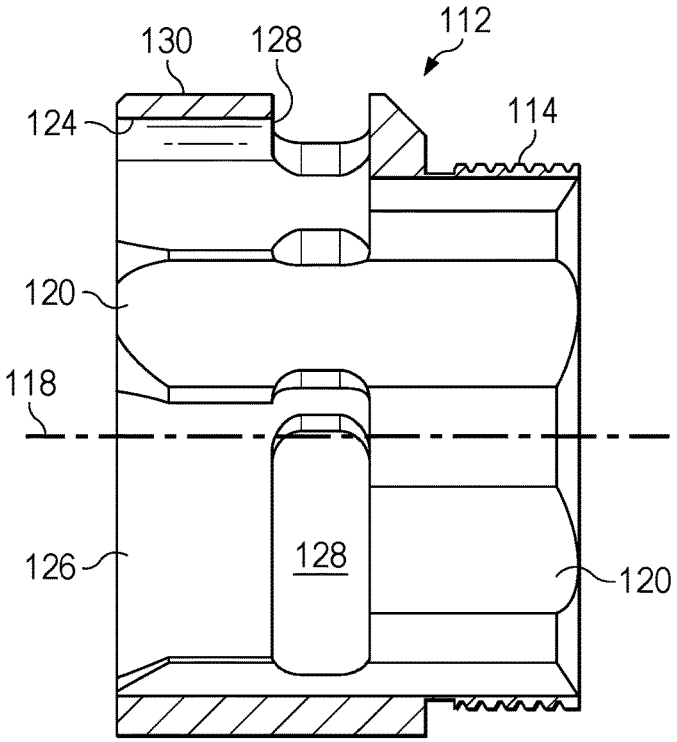
FIG. 9 is a cross-sectional view of the slip housing of FIG. 8 taken along the lines 9-9.

As can be seen in FIG. 8, the interior bore 116 is provided with circumferentially spaced-apart bypass flow passages 120 that extend along the length of the housing 112. The flow passages 120 increase the open transverse cross-sectional area of the interior bore 116. The bypass flow passages 120 increase the transverse cross-sectional area of the interior bore 116 along its length to allow increased fluid to flow through the interior of the slip housing 112, minimizing the obstruction to fluid flow within the well casing caused by the tool assembly 10. In the embodiment shown, the bypass flow passages 120 are configured as six longitudinally extending concave interior surface grooves that are circumferentially spaced approximately 60° apart. The bypass flow passages 120 may have other configurations, with fewer or more of these bypass passages being used in the slip housing 112 in other embodiments.

The exterior wall of the slip housing 112 is generally cylindrical. This can be seen by the circumferential dashed lines 113, shown in FIG. 8. In certain embodiments, the exterior of the slip housing 112 may be provided with circumferentially spaced apart cutout areas 122 that extend along the length of the housing 112. The cutout areas 122 are shown as longitudinally extending flats that each lie in a plane that is parallel to the axis 118. The cutout areas 122 reduce the exterior transverse cross-sectional area of the slip housing 112 along its length to reduce the area taken up by the slip housing 112. This reduction in area is equivalent to the area between the circumferential dashed line 113 and the cutout areas 122. This increases the area of fluid flow within the well casing around the slip housing 112. In the embodiment shown, the cutouts 122 are configured as three longitudinally extending flats formed on the exterior of the slip housing 112 that are circumferentially spaced approximately 120° apart. The cutouts 122 may have other configurations, such as concave arcuate surface instead of being flat, with fewer or more of these cutout areas 122 being used in the slip housing in other embodiments.

The non-threaded end 124 of the slip housing 112 opposite the threaded end 114 is provided with a set of circumferentially spaced apart internal recessed areas 126 for receiving slips of the slip assembly 110. In the embodiment shown, there are three recessed areas 126 spaced 1200 apart. The recessed areas 126 are formed in the interior bore 116 of the slip housing 112 and extend from the end 124 of the slip housing 112 to a slot or open area 128 that is formed in a circumferential wall 130 of the slip housing 112 located between the cutout areas 122.

Figure 10:
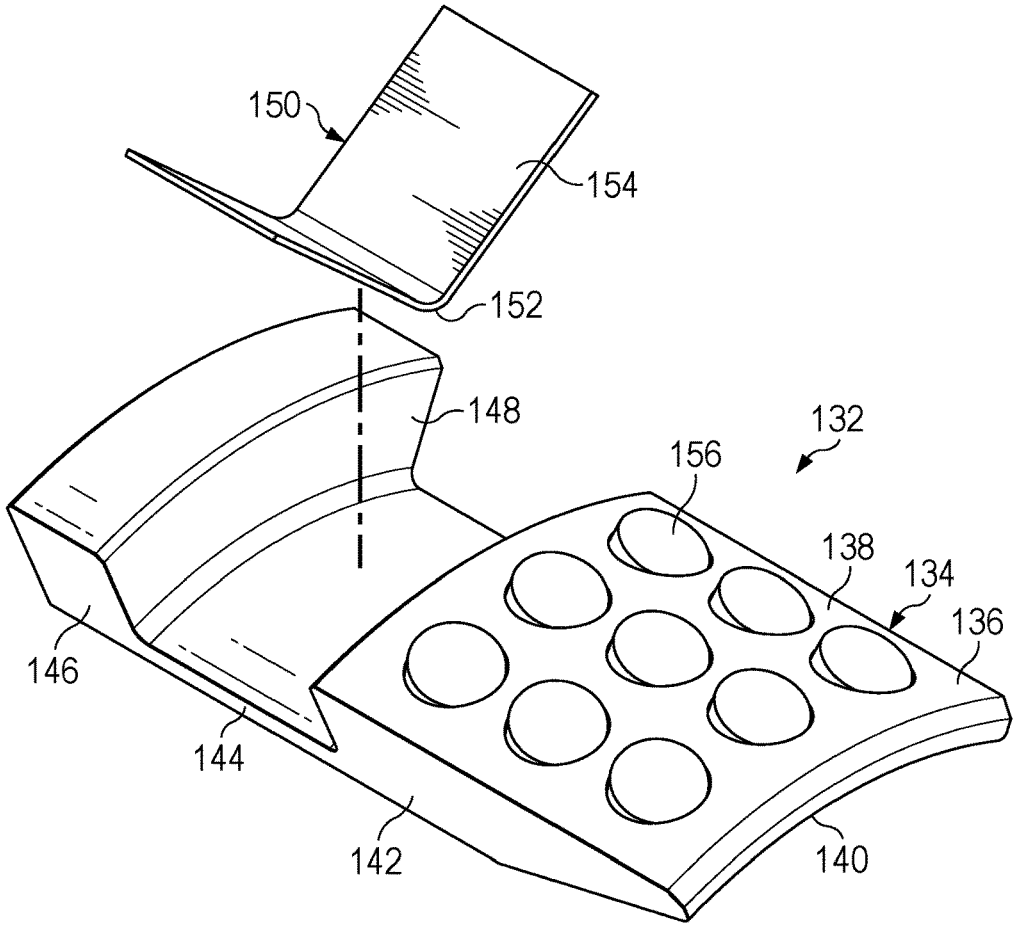
FIG. 10 is a perspective view of a slip of the slip assembly of FIG. 6.
Figure 11:
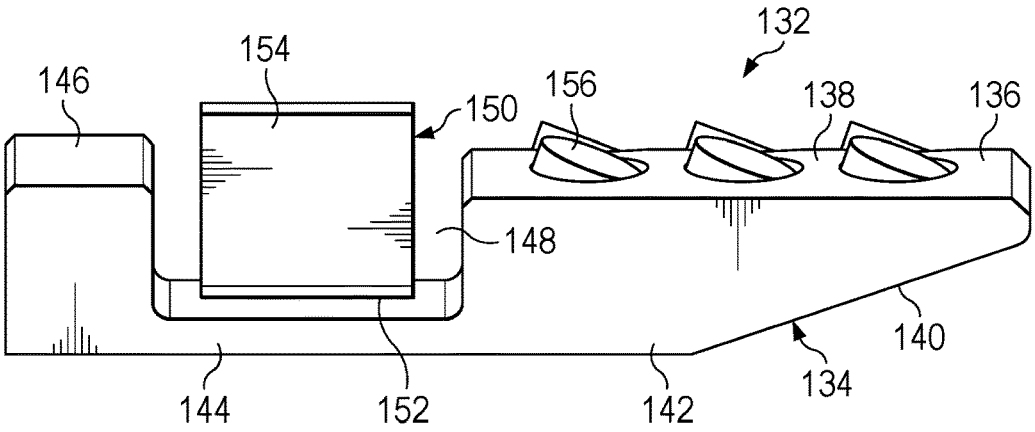
FIG. 11 is a side elevational view of the slip of FIG. 10.

In the embodiment shown, a set of three slips 132 is provided with each slip assembly 110 that are each configured the same. As shown in FIGS. 10 and 11, each slip 132 is comprised of a slip body 134 that has a tapered end portion 136 that is configured generally in a wedge shape. The slip body 134 has an outer face 138 and an opposite inner face 140 that tapers or is sloped inward from the tip of the end portion 136 so that the distance between the outer and inner faces increases along the length of the tapered end portion 136. The inner face 140 then extends generally parallel to the outer face 138 to form a non-tapered portion 142 of the slip body 134 of generally uniform thickness along its length that extends from the tapered end portion 136.

As can be seen in FIG. 10, the outer and inner faces 138, 140 are arcuate surfaces. The outer face 138 may have a convex curvature, with a generally uniform radius of curvature along its length around an axis aligned with the length of the slip body 134. The inner face 140, conversely, may feature a concave curvature.

Extending longitudinally from the inner side of the non-tapered portion 142 of the slip body 134 opposite the tapered portion 136 is a leg 144 of the slip 132. A projecting foot or projecting end portion 146 projects outward from the end of the leg 144 to define a slot or recess 148 between the foot 146 and the non-tapered portion 142 of the slip body 134. The slot or recess 148 is configured to receive a slip spring 150.

In the embodiment shown, the slip spring 150 is shown as a V-shaped biasing member that may be formed from a single piece of thin resilient sheet metal, such as steel, which is bent in the middle across its width to form the V-shape. The V-shaped biasing member 150 is positioned in the slot 148 of the slip 132 with the length of the apex 152 of the V-shaped member 150 resting against the center of the bottom of the slot or recess 148 and being oriented longitudinally with the slip 132. When so positioned, the flat legs 154 of the V-shaped biasing member 150 extend outward and laterally to either side, as shown in FIG. 10.

A set of teeth or projections 156 may be provided in the outer face 138 of the slip body 134. The teeth 156 may be inclined outward from the direction of longitudinal force the slip 132 is configured to encounter during use to help the teeth 156 dig or cut into the walls of the well casing with which the tool assembly 10 is used. The teeth 156 may be formed from a different, harder material (e.g., tungsten carbide) than the material of the well casing to facilitate this digging or cutting action. In certain embodiments, the teeth 156 may be formed as individual inserts that are mounted in apertures formed the outer face 138 of the slip body 134.

Referring to FIG. 6, the slips 132 are mounted in the slip housing 112 by extending the leg 144 and foot 146 of each slip 132 into the interior 116 of the slip housing 112 so that it overlays one of the recessed areas 126, with the foot 146 being received in the slot 128 and the recess 148 overlaying the circumferential wall 130 of the slip housing 112, which is located between the cutout areas 122. When mounted, the legs 154 of the V-shaped spring 150 will abut against the interior of the wall 130 and provide a biasing force against the slip 132 so that the outer face 138 of the slip body 134 is biased or forced inwardly. This causes the slips 132 to be in an inwardly retracted position when the tool assembly 10 is in a released condition, as will be described more fully later. When the slips 132 are mounted and carried by the slip housing 112, the tapered portion 136 and non-tapered portion 142 of the slip body 134 will extend longitudinally from the non-threaded end portion 124 of the slip housing 112, as is shown.

Figure 12:
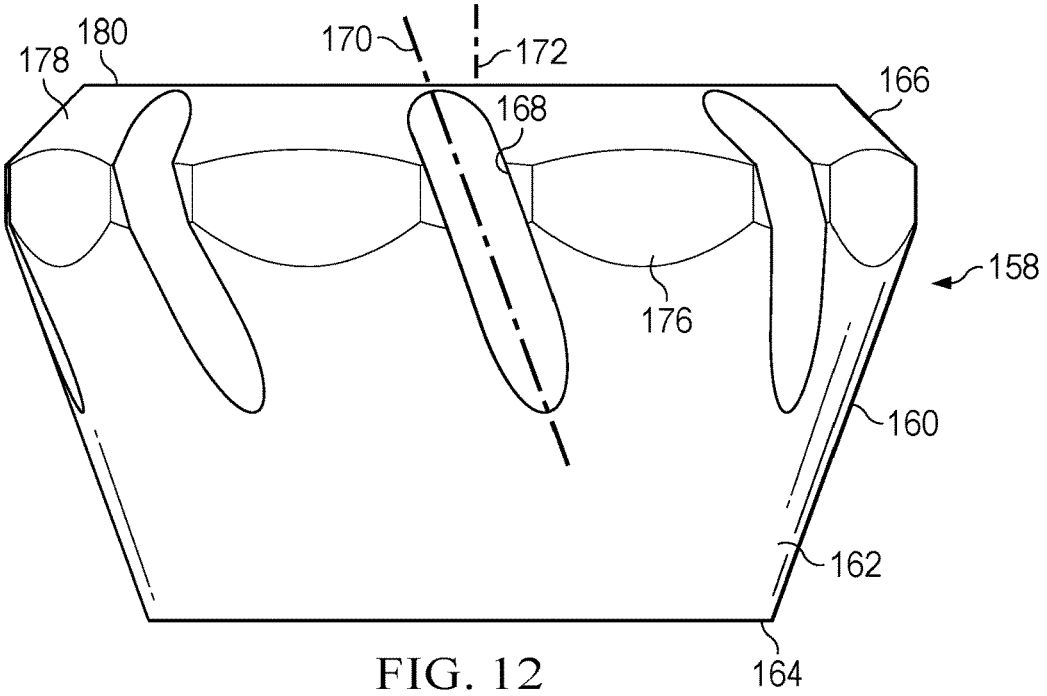
FIG. 12 is a front elevational view of a cone of the tool assembly of FIG. 1.
Figure 13:
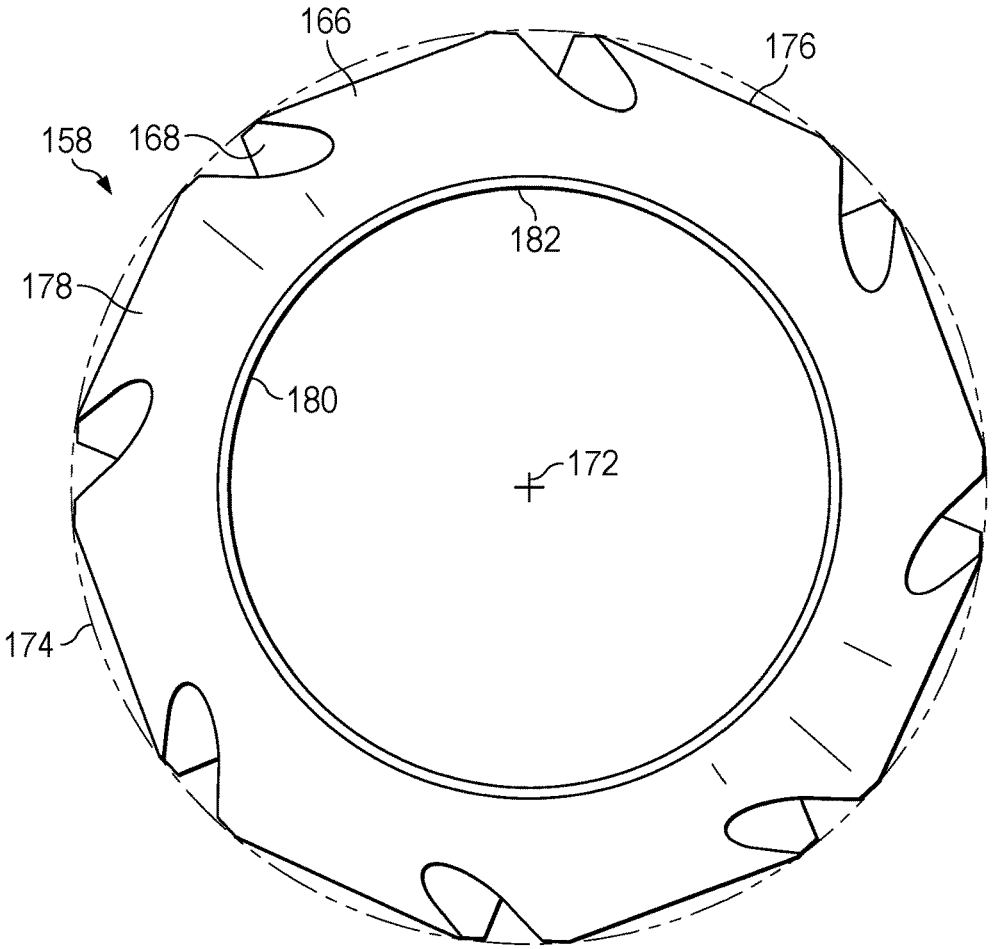
FIG. 13 is a top plan view of the cone of FIG. 12.
Figure 14:
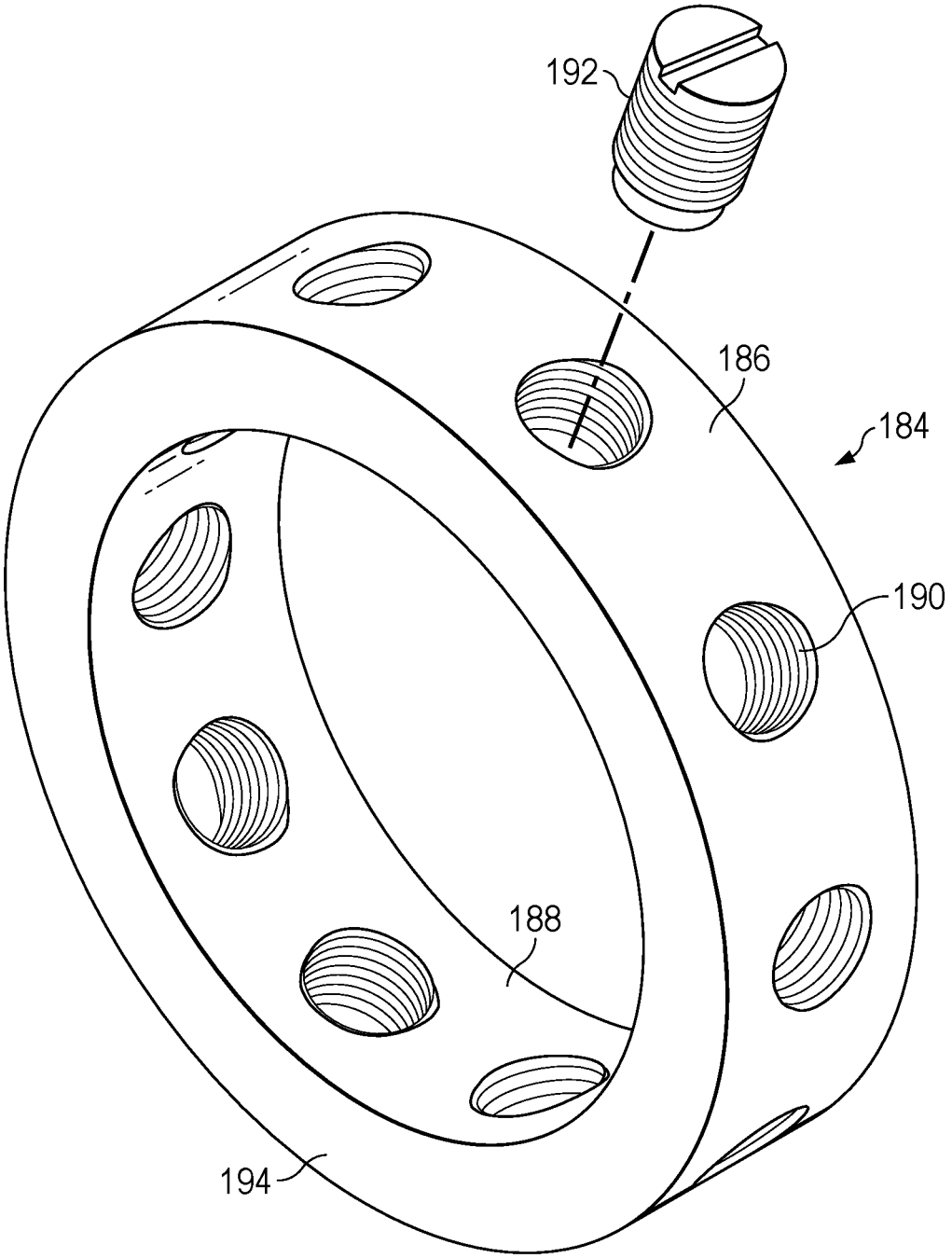
FIG. 14 is a perspective view of a shear ring of the tool assembly of FIG. 1.

The tool assembly 10 also comprises a pair of cones 158, which are each configured similarly. For ease of description, the cones 158 are collectively referred to with the reference numeral 158 but are individually referred to with the reference numerals 158A, 158B. As viewed in FIG. 1, the cone 158A constitutes an upper or catcher cone and the cone 158B constitutes a lower or anchor cone. As shown in FIGS. 12-13, each cone 158 is formed as a unitary body with a frustoconical tapered lower portion 160 having a tapered exterior surface 162 that tapers radially inward along its length to a narrow end 164. The inner face 140 of the tapered end portion 136 of the slip body 134 may be configured to have a concave curvature that corresponds to the tapered exterior surface 162 of the lower portion 160 of the cone 158.

An upper portion 166 of the cone 158 has a series of circumferentially spaced apart grooves or channels 168 formed in its exterior surface. The bottom of each groove or channel 168 may be a concave curve of a constant or variable radius that extends along the length of the groove or channel 168. These grooves or channels 168 constitute flow passages to allow fluid flow past the cone 158 where the cone 158 is at its widest dimension to facilitate increased fluid flow around the cone 158. In the embodiment shown, the grooves or channels 168 are slanted along a line 170 set at a non-parallel angle relative to a central longitudinal axis 172 of the cone 158. The grooves or channels 168 are configured to impart a swirling or helical fluid flow pattern, which may create turbulent fluid flow within the well casing around the tool assembly 10. Such swirling turbulent flow may prevent minerals and particles from settling out and depositing on the surfaces of the tool assembly 10. In other embodiments, the grooves or channels 168 may be oriented along a line that is parallel to the longitudinal axis 172 and configured to impart no such swirling or helical flow pattern.

The outer perimeter of the upper portion 166 of the cone 158 where the cone 158 is widest is generally configured as a cylinder. This can be seen by the circumferential dashed lines 174, shown in FIG. 13. The upper portion of the cone 166 may be provided with circumferentially spaced cutouts or flats 176 located between the grooves or channels 168. The cutouts or flats 176 may be flat areas that are oriented in planes that are parallel to the longitudinal axis 172. These cutouts or flats 176 reduce the cross-sectional area of the cone 158 to facilitate increased fluid flow within the well casing around the cone 158. This reduction in area is equivalent to the area between the circumferential dashed line 174 and the cutout areas 176, as shown in FIG. 13.

As shown in FIG. 12, the upper portion 166 has circumferential beveled or chamfered area that forms frustoconical end portion 178 of the cone 158 that tapers radially inward along the longitudinal axis 170 towards an upper end 180 of the cone 158. The grooves or channels 168 may extend through this frustoconical end portion 178 and into the tapered lower portion 160 of the cone 158.

Referring to FIG. 13, a cylindrical central bore 182 is provided in the cone 158. The central bore 182 has a smooth inner surface and is concentric with and surrounds the central longitudinal axis 172 and has a uniform diameter along its length. The bore 182 is sized and configured to receive the mandrel 12.

The tool assembly 10 further comprises a shear ring 184. The shear ring 184 is formed as a short cylindrical wall 186 of uniform thickness having a central cylindrical opening 188 that has a smooth inner surface and is sized and configured to receive the mandrel 12. A set of circumferentially spaced apart, threaded apertures 190 extend radially through the thickness of the wall 186 for receiving externally threaded shear screws 192. The number, spacing and configuration of the apertures 190 is such that they correspond to and align with the shear ports 52 formed in the mandrel wall 12. When the shear ring 184 is mounted over the mandrel 12, the shear screws 192 are threaded into the apertures 190 so that the inner ends of the shear screws 192 project into the shear ports 52 of the mandrel 12 to hold the shear ring 184 in place. An upper end 194 of the shear ring 184 provides an annular shoulder when mounted to the mandrel 12.

The shear screws 192 are made of a softer material (e.g., brass) than the shear ring 184 and mandrel 12 and may be selected with a particular shear rating so that the screws 192 shear under a given amount of force (e.g., 5,000 lbs/screw). Thus, for example, if there are ten apertures 190 in the shear ring 184, each aperture 190 having a shear screw 192 that has a shear strength of 5,000 lbs/screw, the shear ring 184 should be held in place when subjected to a force from 50,000 lbs or less before the shear ring 184 fails and is freed from the mandrel 12. By increasing or decreasing the number of shear screws 192 of known shear strength used with the shear ring 184, a user can select the desired degree of force required to shear apart and disengage the shear ring 184 from the mandrel 12.

In assembly of the tool assembly 10, the upper cone 158A (FIG. 4) is mounted over the mandrel 12 by passing the upper end 20 of the mandrel 12 through the central bore 182 of the cone 158A so that the narrow end 164 of cone 158A abuts and rests against the upward facing annular shoulder 46 of the mandrel 12. The upper coupling 24, having a greater diameter than the mandrel 12 so that it creates a lower facing shoulder, may then be threaded onto upper end 20 to secure the cone 158A in place on the upper end 20 of the mandrel 12, as shown in FIG. 1.

The threaded end 114 of upper slip assembly 110A is threaded into and coupled to the upper end 106 of the control body 54 and the lower slip assembly 110B is threaded into and coupled to the lower end 108 of the control body 54. The control body 54 with the slip assemblies 110 is passed over the lower end 22 of the mandrel 12, with the mandrel 12 being received within the central opening 60 of the control body 54 and interior bores 116 of the slip housings 112. When the control body 54 is mounted over the mandrel 12, as shown in FIG. 3, the exterior of the mandrel wall 14 is spaced radially inward from the interior of the control body wall 56 to define annular spaces 196. These annular spaces 196 create flow passages that allow fluid to flow within the annular spaces 196 between the mandrel 12 and control body 54.

With the control body 54 mounted over the mandrel 12, the control pins 38 can be positioned within the set of slots 66 and screwed into the threaded ports 36 through the open areas of the slots 66. As shown in FIG. 3, outer end 42 of the control pin 38 will not project out of the slots 66 but will be flush or slightly recessed within the slots 66. This provides a clearance so that the control pin 38 does not contact the reinforcement plate 104 that is mounted over the run slot 68.

The lower cone 158B (FIG. 4) is then mounted over the mandrel 12 by passing the cone 158B over the lower end 22 of the mandrel 12 through the central bore 182 of the cone 158B so that the narrow end 164 of cone 158B abuts and rests against the lower annular shoulder 48 (FIG. 2). The shear ring 184 is then mounted over the mandrel 12 with the threaded apertures 190 aligning with the shear ports 52 formed in the mandrel wall 14. The desired number of shear screws 192 are then threaded into the apertures 190 so that the inner end 171 of the shear screws project into the shear ports 52 of the mandrel 12. With the shear ring 184 is mounted, the end 180 of lower cone 158B will abut and rest against the upper end 194 of shear ring 184 so that the lower cone 158B is secured in place on the mandrel 12 between the lower annular shoulder 48 and shear ring 184.

The lower coupling 26 may then be threaded onto the lower end 22 of the mandrel. As can be seen in FIG. 1, the upper end 28 of bottom coupling 26 is longitudinally spaced below the shear ring 184 on the mandrel 12. When the shear ring 184 parts due to excessive force and shearing, the shear ring 184 and lower cone 158B will drop away on the mandrel 12 so that the shear ring 184 and cone 158B rest on the upper end 28 of the bottom coupling 26.

When so assembled, the central axes 58, 118, 172 of the control body 54, slip housing 112 of the slip assemblies 110A, 110B and cones 158A, 158B, respectively, may be aligned, parallel, and/or concentric with central longitudinal axis 16 of the mandrel 12.

Figure 15:
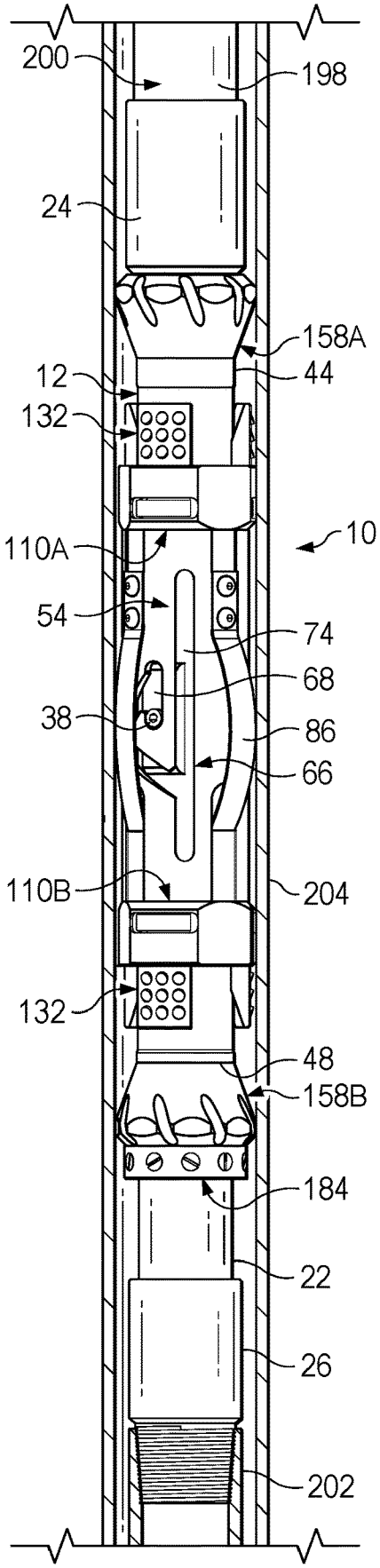
FIG. 15 is a front elevational view of the tool assembly of FIG. 1, positioned within a well casing and shown in a neutral or released condition.

In operation, as shown in FIG. 15, the tool assembly 10 is coupled at the top coupling 24 to the lower end of tubing 198 of a tubing string 200 used in a well, such as an oil and/or gas well. The bottom coupling 26 likewise is coupled at the lower end 30 to lower tubing 202 of the tubing string 200 or other well equipment (not shown) that may be coupled to the bottom coupling 26. When the tool assembly 10 is coupled to the tubing string 200, the tool assembly 10 is lowered or run into a well casing 204 of the well. Initially, during the lowering or running of the tubing string and tool assembly 10 into the well casing 204, the control pin 38 of the tool assembly will be positioned and maintained within the run slot 68.

Figure 16:
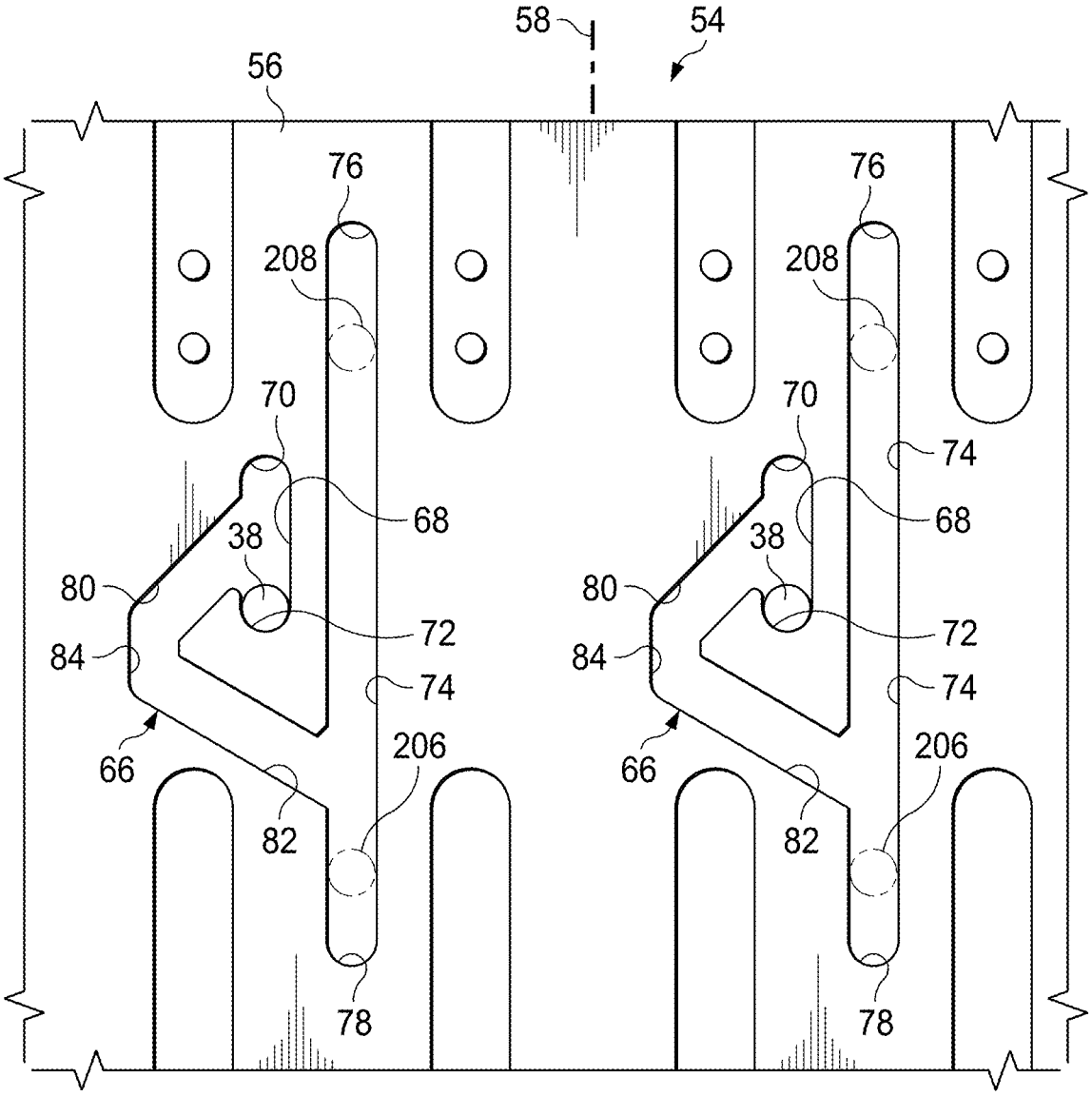
FIG. 16 is a schematic representation of the control body of FIG. 4, shown flattened out to illustrate a set of interconnected slots of the control body configured to provide right-hand (RH)/RH release operation of the tool assembly.

FIG. 16 shows a more detailed view of the control pins 38 and two interconnected slot sets 66 formed in the control body wall 56. For ease of understanding, the cylindrical control body wall 14 shown in FIG. 16 is shown schematically in a flattened condition to better illustrate the movement of the control pins 38 within the two slot sets 66. As discussed previously, there may be two identical slot sets 66 that are positioned on opposite sides of the control body 54 circumferentially spaced 180° apart, each slot set receiving a single control pin 38. Because the slot sets 66 are configured the same, the movement of the control pins 38 with the slots will be the same. The configuration of the slot sets 66 of the control body 54 of FIG. 16 provides the RH set/RH release actuation for the tool assembly 10.

As the tool assembly 10 is run into the well casing, the control pin 38 will abut and push against the bottom end 72 of the shorter run slot 68, as shown in FIGS. 15 and 16. When the tool assembly 10 is located within the well casing 204, the control springs 86 on the outside of the control body 18 contact and engage the interior of the well casing 204. The control springs 86 each constituting a drag body that provides a degree of resistance to movement of the control body 54 relative to the well casing 204 and/or mandrel 12. The slip springs 86 thus facilitate maintaining the control body 54 and the slip assemblies 110A, 110B coupled thereto stationary within the well casing 204 and prevent movement of the control body 54 slip assemblies 110A, 110B relative to the mandrel 12 to perform the operations described herein. The shorter run slot 68 prevents the mandrel 12 from further downward movement through the control body 54 as the tool assembly 10 is lowered through the casing 204. Because of the position of the run slot 68 at or near the center of the control body 54 and its shorter length, the upper cone 158A carried by the mandrel 12 is prevented from being lowered further and engaging the upper slip assembly 110A so the individual slips 132, which are inwardly biased by the slip springs 150, are each retracted away from the interior walls of the well casing 204 in a retracted condition. This facilitates maintaining the tool assembly 10 in a released condition where neither of the slip assemblies 110A, 110B are in engagement or in contact with the well casing 204.

When the tubing string 200 and tool assembly 10 are run into and positioned in the well casing 204 at the depth where it is to be set and it is desired to anchor the tubing string, slight upward tension is placed on the tubing string 200. This acts on the mandrel 12 and causes the control pin 38 to ride upward in the run slot 68 to its upper end 70. Once at this position, the tubing string 200 is rotated to the right or clockwise (as viewed from above) and the upward tension on the tubing string 200 is released. This causes the tubing string 200 and mandrel 12 to drop, with the control pin 38 traveling through the upper and lower passage slots 80, 82 and transition slot 84 and downward to the left into set slot 74. In the embodiment shown, very little rotation of the tubing string 200 is required to position the control pin 38 in the set slot 74 as the circumferential distance from the run slot 68 to the transition slot 84 is only about 350 and the total amount of rotation encountered as the control pin 38 passes from the furthermost transition slot 84 to the set slot 74 is only about 65°, or substantially less than a quarter (90°) turn.

Figure 17:
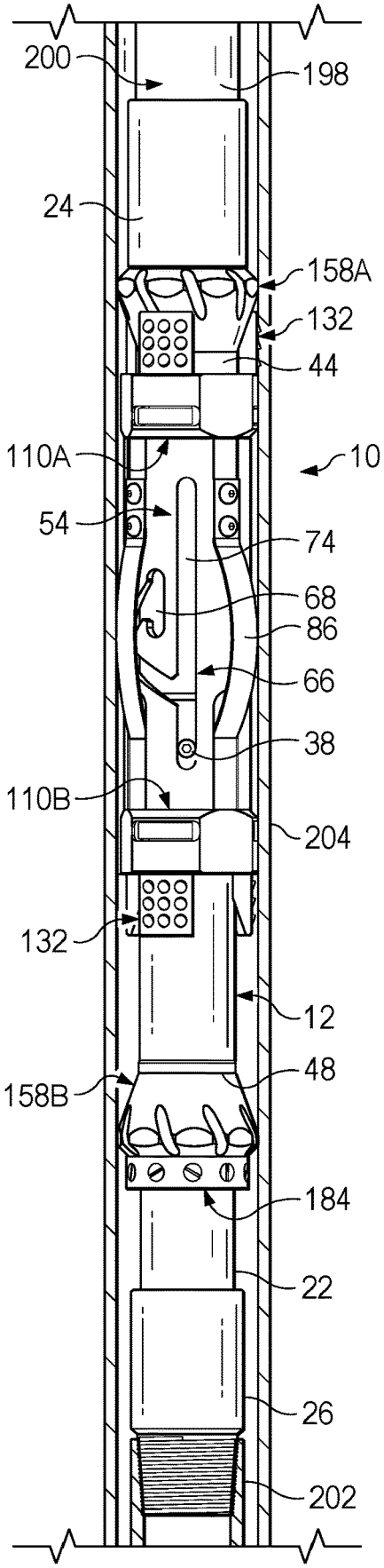
FIG. 17 is a front elevational view of the tool assembly of FIG. 15, positioned within a well casing and shown in a caught condition.

Once the control pin 38 is in the set slot 74, the control pin 38 and mandrel 12 will drop further into the lower portion of the longer set slot 74 to a longitudinal position that is below the run slot 68, as shown at 206. The upper cone 158A carried by the mandrel 12 will also drop so that the tapered portion 160 of the upper cone 158A contacts and slides along the tapered inner face 140 of the slips 132 of upper slip assembly 110A. This forces the slips 132 of upper slip assembly 110A radially outward so that the outer faces 138 of the slips 132 are forced towards the interior wall of the well casing 204, as shown in FIG. 17, so that the teeth 156 of the outer face 138 will bite or grip into the wall of the casing 204. Sufficient force is exerted against the slips 132 of the upper slip assembly 110A so that the tool assembly 10 and tubing string 200 are held in a stationary, caught position and the tubing string 200 and tool assembly 10 are prevented from further downward movement. The teeth 156 of the outer face 138 bite or grip into the wall of the casing 204 with sufficient force to facilitate holding the tool assembly 10 and tubing string 200 in this position. It should be noted that when the slips 132 of upper slip assembly 110A engage and contact the well casing 204, further downward movement of the control pin 38 from the lower position 206 within the set slot 74 is prevented. Thus, the control pin 38 does not contact the lower end 78 of the set slot 74. This ensures that no force is exerted on the control pin 38 while it is in the set slot 74 at the lower position 206 when the tool assembly 10 is in this caught condition.

By lifting the tubing string 200 and placing the tubing string 200 in upward tension, the mandrel 12 is lifted so that the upper cone 158A is lifted and disengaged from the upper slip assembly 110A. This causes the slips 132 of the upper slip assembly 110A to return to the inward retracted position and away from the wall of the well casing 204 so that the tool assembly 10 is in a released condition.

Figure 18:
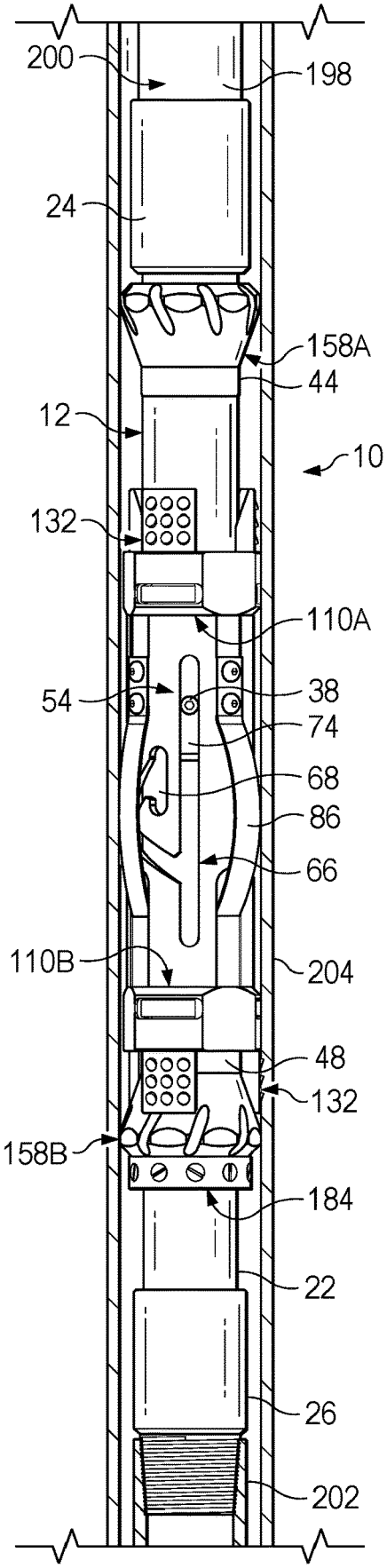
FIG. 18 is a front elevational view of the tool assembly of FIG. 15, positioned within a well casing and shown in an anchored condition.

Continued upward movement of the tubing string 200 and mandrel 12 will move the control pin 38 upward within the set slot 74 to an upper position, as shown at 208, which is located above the upper end 70 of the run slot 68. This movement lifts the lower cone 158B upward and into engagement with the lower slip assembly 110B. As the lower cone 158B engages the lower slip assembly 110B, the tapered portion 160 of the lower cone 158B contacts and slides along the tapered end inner face 140 of the slips 132 of lower slip assembly 110B. This forces the slips 132 of lower slip assembly 110B radially outward so that the outer faces 138 of the slips 132 with the teeth 156 are forced into contact with the interior wall of the well casing 204, as shown in FIG. 18. While upward tension of the tubing string is maintained, sufficient force is exerted against the slips 132 of the lower slip assembly 110B so that the tool assembly 10 and tubing string 200 are held in a stationary, anchored condition and the tubing string 200 and tool assembly 10 are prevented from further upward movement. The teeth 156 of the outer face 138 will also bite or grip into the wall of the casing 204 to facilitate holding the tool assembly 10 and tubing string 200 in this anchored condition.

It should be noted, as well, that when the slips 132 of lower slip assembly 110B engage and contact the well casing 204, further upward movement of the control pin 38 within the set slot 74 is prevented and the control pin 38 does not contact the upper end 76 of the set slot 74. Thus, no force is exerted on the control pin 38 while it is in the set slot 74 at the upper position 208 when the tool assembly 10 is in under upward tension or in the anchored condition. When anchored, the tubing string 200 can be used in a normal fashion, such as for pumping well fluids, etc.

If the event that the tubing string 200 happens to part or fail above the tool assembly 10 while the control pin 38 is located in the set slot 74, the mandrel 12 will drop causing the control pin 38 to drop to the lower position 206. This causes the upper cone 158A to engage the upper slip assembly 110A so that the slips 132 contact and engage the well casing 204. This prevents the tubing 200 from falling or hitting the bottom of the well, which could otherwise damage the tubing, well casing and/or other well equipment of the well.

To release the anchor assembly 10, a right-hand (RH) release is used wherein the tubing string 200 is rotated to the right (i.e., clockwise), as viewed from above. This is achieved by releasing upward tension on the tubing string 200 when it is the anchored condition so that the mandrel 12 and control pin 38 drop. This disengages the lower slip assembly 110B from the lower cone 158B so that the slips 132 are retracted and disengaged from the well casing 204. The tubing string is then rotated to the right so that the mandrel 12 is rotated and the control pin 38 enters the lower passage slot 82. The control pin 38 follows the lower passage slot 82 and upper passage slot 80 to the run slot where the tool assembly 10 is in a neutral condition where neither of the upper and lower slip assemblies 110A, 110B are engaged with the well casing 204 and the tubing string 200 and tool assembly 10 can be withdrawn or repositioned.

The shear ring 186 of the tool assembly 10 also prevents the tool assembly 10 from being caught or stuck in an anchored condition. If the tool assembly 10 happens to be stuck in the anchored condition, with the lower cone 158B remaining engaged with the lower slip assembly 110B, so that the tubing string 200 cannot be moved or repositioned, the shear ring 186 can be sheared away to release the tool assembly 10. This is achieved by increasing the upward tension on the tubing string 200 so that the force exerted by the lower cone 158 against the shear ring 184 by this upward tension exceeds the shear strength of the shear screws 192 and causes the shear screws 192 to shear and fail. Once the screws 192 are sheared, the shear ring 184 and lower cone 158B will drop away from the lower slip assembly 110B, resting on lower coupling 26. The slip assembly 110B will then disengage from the well casing 204 and the tubing string 200 and tool assembly 10 can be withdrawn.

Figure 19:
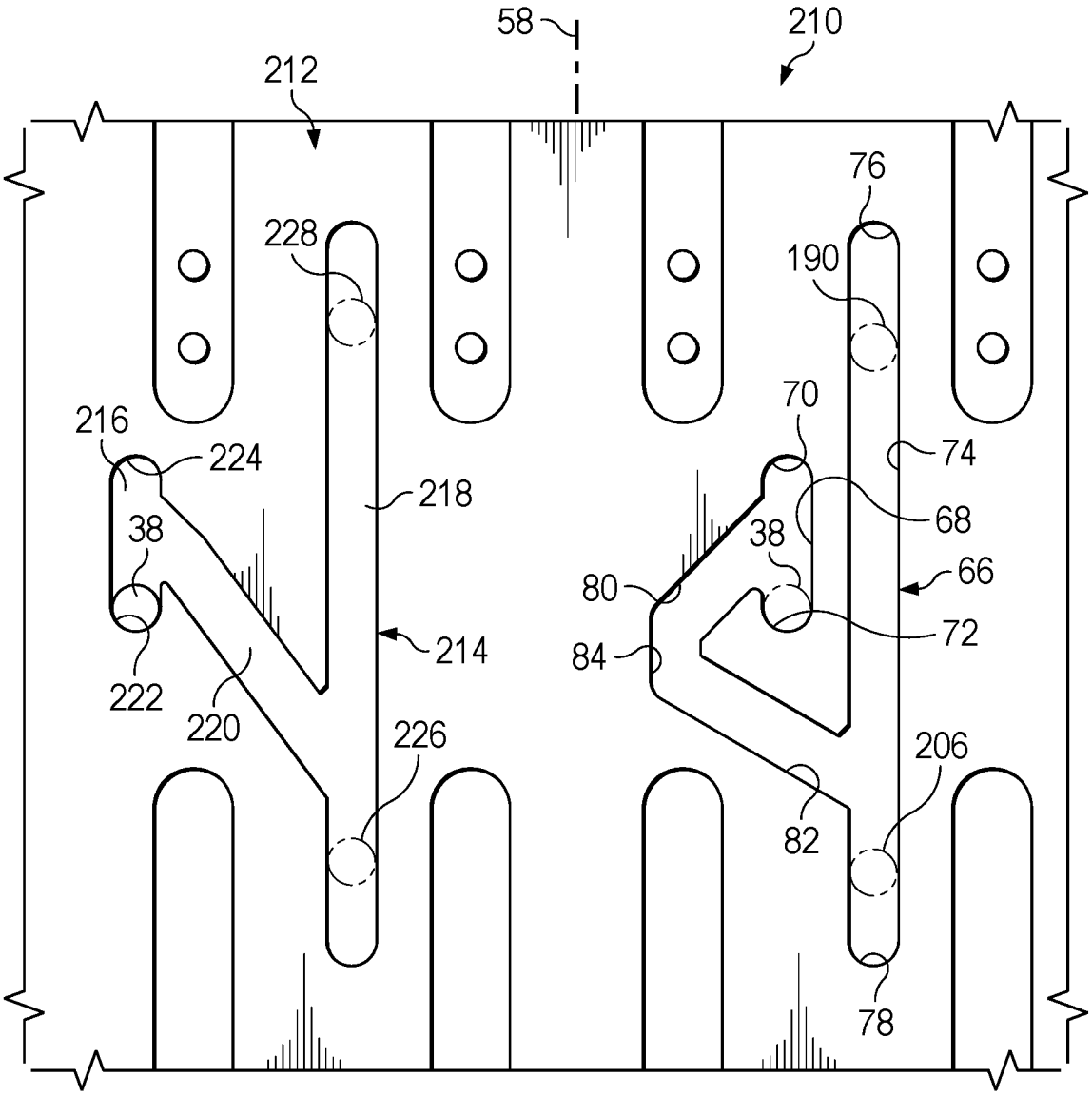
FIG. 19 is a schematic representation of another embodiment of a control body for use with the tool assembly of FIG. 1, shown flattened out to illustrate a set of interconnected slots of the control body configured to selectively provide RH set/left-hand (LH) release or RH set/RH release operation of the tool assembly.

FIG. 19 shows an alternate embodiment of a control body 210 for use with the tool assembly 10. The various components of the tool assembly 10 for use with the control body 210 in all respects is the same for that used with the control body 54, with similar components labeled with the same reference numerals. The control body 210 has a control body wall 212, which is similar to the control body wall 56 of control body 54. For ease of understanding, the cylindrical control body wall 212 is shown schematically in a flattened condition to better illustrate its configuration and functioning. The control body wall 212 is provided with a single set of interconnected slots 66 configured the same as those of control body 54 for RH set/RH release, as was described previously.

The control body 210 differs from the control body 54 in that it also includes a different single set of interconnected slots 214 that constitutes a lefthand (LH) set/righthand (RH) release set of slots. In this embodiment, the two different sets of slots 66, 214 may also be circumferentially spaced on opposite sides or approximately 1800 apart on the control body wall 212. In the embodiment of FIG. 19, however, only a single control pin 38 is used with the control body 210, which is selectively positioned in only one of the two sets of interconnected slots 66, 214 for either RH set/RH release or LH set/RH release, but not both.

For RH set/RH release the control pin 38 is positioned in the set of slots 66, with no control pin residing in the set of interconnected slots 214. With the control pin 38 positioned within the interconnected slots 66 the operation is the same as that for the tool assembly 10 employing the RH set/RH release control body 54, as previously described.

For LH set/RH release, the control pin 38 is positioned in the interconnected set of slots 214, while no control pin is used in the set of slots 66 for RH set/RH release. The set of slots 214 include a longitudinal run slot 216 and a longitudinal set slot 218, which may each be similar in size, longitudinal position and configuration to the run slot 68 and set slot 74, respectively, as previously described for control body 54.

The run slot 216 of slot set 214 is circumferentially spaced apart on the control body wall 212 from the set slot 218 no further than 90°, 85°, 80°, 75°, 70°, 65°, 60°, 55°, 50°, 45°, 40°, 35°, 30°, 25°, 20°, 15°, 10° or less, as measured from the center line of each slot. In certain embodiments run slot 216 and set slot 218 of the set of interconnected slots 214 are circumferentially spaced apart from one another on the control body wall 212 from at least, equal to, and/or between any two of 10°, 11°, 12°, 13°, 14°, 15°, 16°, 17°, 18°, 19°, 20°, 21°, 22°, 23°, 24°, 25°, 26°, 27°, 28°, 29°, 30°, 31°, 32°, 33°, 34°, 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, 60°, 61°, 62°, 63°, 64°, 65°, 66°, 67°, 68°, 69°, 70°, 71°, 72°, 73°, 74°, 75°, 76°, 77°, 78°, 79°, 80°, 81°, 82°, 83°, 84°, 85°, 86°, 87°, 88°, 89°, and 90°, as measured from the center line of each slot 216, 218. In the embodiment shown, the run slot 216 is circumferentially spaced from the set slot 218 approximately 75°.

As viewed in FIG. 19, a single passage slot 220 opens into and extends from the right side of run slot 216. The passage slot 220 is sloped or angled downward from the run slot 216 towards the right towards the set slot 218. The lower end of the lower passage slot 220 opens into the left side of the set slot 218 at a longitudinal position below the lower end 222 of the run slot 216, as is shown. The passage slot 220 may be oriented downward to the right from the run slot 216 at an angle of from 30° to 60°, more particularly from 40° to 50°, relative to the longitudinal axis 58 of the control body 210. In particular embodiments, the passage slot 220 may be oriented at an angle of from at least, equal to, and/or between any two of 30°, 31°, 32°, 33°, 34°, 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, and 70°, relative to the longitudinal axis 58 of the control body 210.

The longitudinal position of the lower end of the passage slot 220 where it opens into and meets the set slot 218 should be at a location on the set slot 218 where the control pin 38 and mandrel 12 are still at a position where the tool assembly 10 is maintained in a released condition or at a position where tool assembly 10 just enters into the set condition.

In use of the tool assembly 10 employing the control body 210 of FIG. 19, when the control pin 38 is selectively positioned within the interconnected slots 66 for RH set/RH release, the operation is the same as that previously described for the control body 54.

If the control pin 38 is positioned within the interconnected slots 214 for LH set/RH release the operation is as follows. As the tool assembly 10 is run into the well casing, the control pin 38 will abut and push against the bottom end 222 of the shortened run slot 216, as shown in FIG. 19. In this position, the tool assembly 10 is in a neutral condition where the slip assemblies 110A, 110B are out of engagement with the well casing 204.

With the control pin 38 abutting the bottom end 222 of the run slot 216, when the tubing string and tool assembly 10 employing control body 210 are run into and positioned in the well casing 204 at the depth where it is to be set and it is desired to anchor the tubing string, slight upward tension is placed on the tubing string 200. This acts on the mandrel 12 and causes the control pin 38 to ride upward in the run slot 216 to its upper end 224. Once at this position, the tubing string 200 is rotated to the left or counterclockwise (as viewed from above) and the upward tension on the tubing string 200 is released. This causes the tubing string 200 and mandrel 12 to drop, with the control pin 38 traveling through the passage slot 220 and into set slot 218. In the embodiment shown, the total amount of rotation by the tubing string 200 and mandrel 12 as the control pin 38 passes from the run slot 216 to the set slot 218 and vice versa is 75°, or less than a quarter (i.e., 90°) turn.

Once the control pin 38 is in the set slot 218, the control pin 38 and mandrel 12 will drop further into the lower portion of the longer set slot 218 to a longitudinal position 226 that is below the lower end 222 of the run slot 216. This causes the upper cone 158A to drop and engage the slip assembly 110A, causing the upper slip assembly 110A to engage the well casing 204 so that the tool assembly 10 is maintained in a stationary, caught condition. The teeth 156 of the outer face 138 will bite or grip into the wall of the casing 204 to facilitate holding the tool assembly 10 and tubing string 200 in this position. It should be noted that when the slips 132 of upper slip assembly 110A engage and contact the well casing 204, further downward movement of the control pin 38 from the lower position 226 within the set slot 218 is prevented. Thus, no force is exerted on the control pin 38 while it is in the set slot 218 at the lower position 226 when the tool assembly 10 is in this caught condition.

By lifting the tubing string and placing the tubing string in upward tension, the mandrel 12 of the tool assembly 10 employing the control body 212 is lifted so that upper cone 158A is lifted out of engagement with the slip assembly 110A and the slip assembly 110A is disengaged from the well casing 204.

Continued upward movement of the tubing string 200 and mandrel 12 will move the control pin 38 upward within the set slot 218 to an upper position 228, which is located above the upper end 224 of the run slot 68. This movement lifts the lower cone 158B upward and into engagement with the lower slip assembly 110B so that the lower slip assembly 110B engages the walls of the well casing 204. While upward tension of the tubing string is maintained, the lower slip assembly 110B is held in engagement with the well casing 204 to facilitate holding the tool assembly 10 employing the control body 210 and tubing string 200 in an anchored condition to prevent further upward movement.

To release the tool assembly 10 employing the control body 210, with the control pin 38 in the set slot 218, a right-hand (RH) release is used wherein the tubing string 200 is rotated to the right (i.e., clockwise), as viewed from above. This is achieved by releasing upward tension on the tubing string 200 so that the mandrel 12 and the control pin 38 drops to a lower position within the set slot 218. This disengages the lower cone 158B from the lower slip assembly 110B so that the slips 132 are retracted and the lower slip assembly 110B is disengaged from the well casing 204. The tubing string 200 is then rotated to the right so that the mandrel 12 is rotated and the control pin 38 enters the passage slot 220. The control pin 38 follows the passage slot 220 to the run slot 216 where the tool assembly 10 is in a neutral condition where neither of the upper and lower slip assemblies 110A, 110B are engaged with the well casing 204 and the tubing string 200 and tool assembly 10 can be withdrawn or repositioned.

The control body 210 employing the two different slot configurations 66, 214 allows the operator to select whether they want to use the tool assembly 10 in an RH set/RH release operation or a LH set/RH release operation. Operators may select this LH set/RH release option as it is the typical operation for conventional anchor tools and may be more familiar to well operators when setting and releasing conventional anchor/catcher assemblies.

Figure 20:
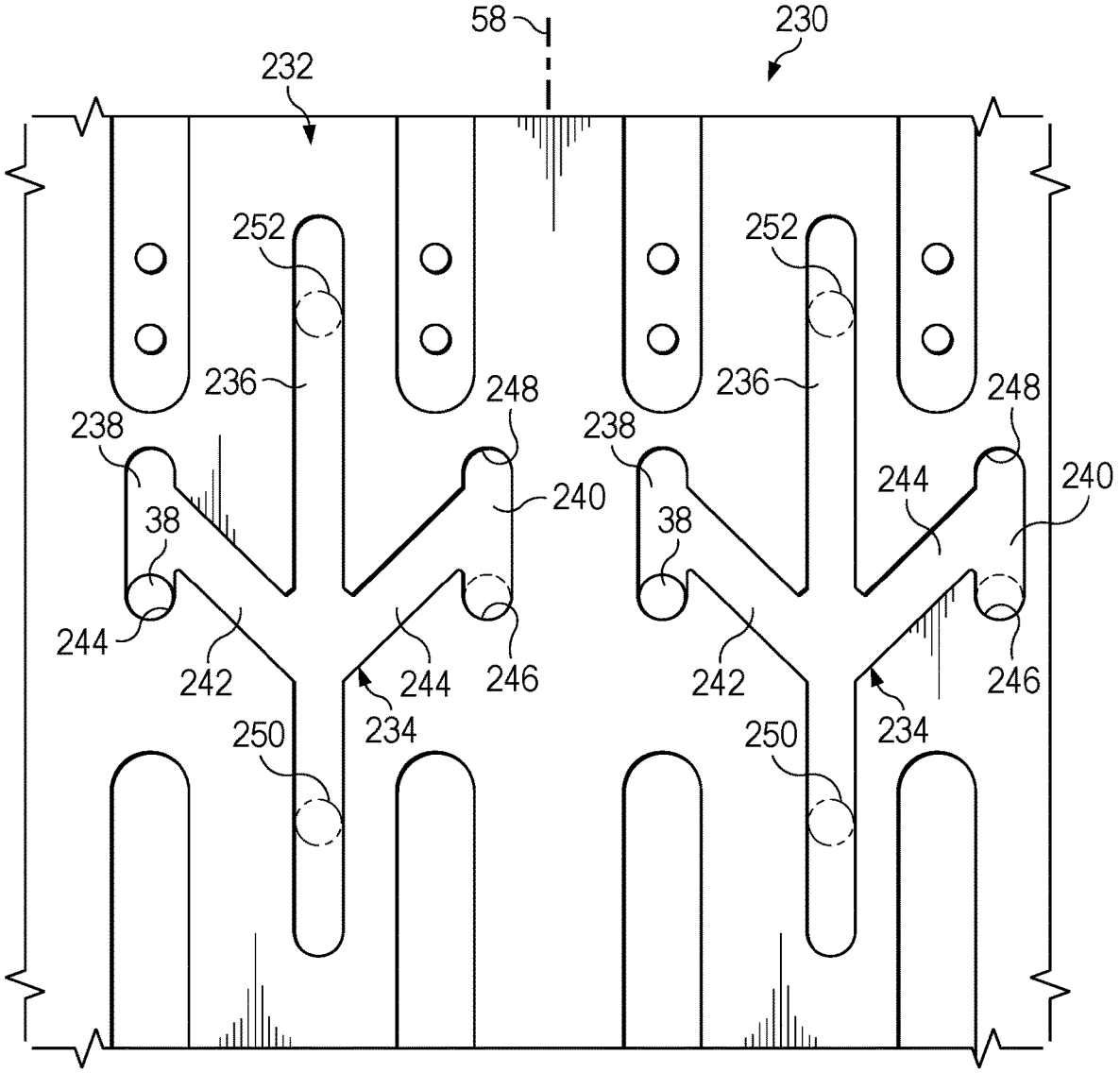
FIG. 20 is a schematic representation of still another embodiment of a control body for use with the tool assembly of FIG. 1, shown flattened out to illustrate a set of interconnected slots of the control body configured to selectively provide any one of RH set/RH release, RH set/LH release, LH set/RH release, or LH set/LH release operation of the tool assembly.

FIG. 20 shows a further embodiment of a control body 230 having a control body wall 232 that may be employed with the tool assembly 10. The various components of the tool assembly 10 for use with the control body 230 in all respects is the same for that used with the control body 54, with similar components labeled with the same reference numerals. For ease of understanding, the cylindrical control body wall 232 is shown schematically in a flattened condition to better illustrate its configuration and functioning.

The control body 230 is similar to the control bodies 54, 210, previously described. The control body wall 232 differs, however, in that it employs two sets of interconnected slots 234 configured so that tool assembly 10 can be either RH set/RH release, LH set/LH release, RH set/LH release, or LH set/RH release. The two sets of interconnected slots 234 are configured the same and are circumferentially spaced 1800 apart on the control body wall 232. A control pin 38 may be simultaneously used in each set of slots 234.

Each set of slots 234 includes a single, longitudinal set slot 236 that is similar in size, longitudinal position on the control body 230 and configuration to the set slots 74, 218 of control bodies 54, 210, as previously described.

As viewed in FIG. 20, circumferentially spaced apart from the set slot 236 of each slot set 234 to the left is a LH set/RH release run slot 238. Circumferentially spaced apart from the set slot 236 to the right on the opposite side is a RH set/LH release run slot 240, with the set slot 236 being equally spaced between each of the run slots 238, 240. Each run slot 238, 240 is a longitudinal slot that is similar in size, longitudinal position on the control body 230 and configuration to the run slots 68, 216, as previously described.

Each run slot 238, 240 is circumferentially spaced apart on the control body wall 232 from the set slot 236 no further than 90°, 85°, 80°, 75°, 70°, 65°, 60°, 55°, 50°, 45°, 40°, 35°, 30°, 25°, 20°, 15°, 100 or less, as measured from a center line of each slot. In certain embodiments, each of the run slots 238, 240 of the set of interconnected slots 234 is circumferentially spaced apart from the set slot 236 on the control body wall 232 from at least, equal to, and/or between any two of 10°, 11°, 12°, 13°, 14°, 15°, 16°, 17°, 18°, 19°, 20°, 21°, 22°, 23°, 24°, 25°, 26°, 27°, 28°, 29°, 30°, 31°, 32°, 33°, 34°, 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, 60°, 61°, 62°, 63°, 64°, 65°, 66°, 67°, 68°, 69°, 70°, 71°, 72°, 73°, 74°, 75°, 76°, 77°, 78°, 79°, 80°, 81°, 82°, 83°, 84°, 85°, 86°, 87°, 88°, 89°, and 90°, as measured from the center line of each run slot 238, 240 and set slot 236. In the embodiment shown in FIG. 20, each of the run slots 238, 240 is circumferentially spaced from the set slot 236 approximately 75°.

The LH set/RH release run slot 238 in combination with the set slot 236 is configured similarly to the slot set 214 of the control body 210 of FIG. 19. Like the set slot 214 of FIG. 19, a single passage slot 242 opens into and extends from the right side of run slot 238. The passage slot 242 is angled downward from the run slot 238 towards the right towards the set slot 236. The lower end of the passage slot 242 opens into the left side of the set slot 236 at a longitudinal position below the lower end of the run slot 238, as is shown. The passage slot 242 may be oriented downward to the right from the run slot 238 at an angle of from 30° to 60°, more particularly from 40° to 50°, relative to the longitudinal axis 58 of the control body 230. In particular embodiments, the passage slot 242 may be oriented at an angle of from at least, equal to, and/or between any two of 30°, 31°, 32°, 33°, 34°, 35°, 36°, 37°, 38°, 39°, 40° 41°, 42°, 43°, 44°, 45° 46°, 47°, 48°, 49° 50°, 51°, 52°, 53°, 54°, 55°, 56°, 57°, 58°, 59°, and 70°, relative to the longitudinal axis 58 of the control body 230.

In a similar manner the RH set/LH release run slot 240 has a single passage slot 244 that opens into and extends from the left side of run slot 240. The passage slot 244 is angled downward from the run slot 240 towards the left towards the set slot 236. The lower end of the passage slot 244 opens into the right side of the set slot 236 at a longitudinal position below the lower end of the run slot 240, as is shown. The passage slot 244 may be oriented downward to the left of the run slot 240 at an angle of from 30° to 60°, more particularly from 40° to 50°, relative to the longitudinal axis 58 of the control body 230. In particular embodiments, the passage slot 244 may be oriented at an angle of from at least, equal to, and/or between any two of 30°, 31°, 32°, 33°, 34°, 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, and 70°, relative to the longitudinal axis 58 of the control body 230.

In use, when the control pin 38 is initially in the LH set/RH release run slot 238, the operation of the tool assembly 10 employing the control body 230 is generally the same for a LH set/RH release operation as that described for the control body 210 of FIG. 19, when the control pin 38 is located in the set of interconnected slots 214 for LH set/RH release. In FIG. 20, with control pin 38 in the set slot 236 of control body 230, however, a LH release operation may be performed to release the tool assembly 10 to a released condition. Thus, after tension is released from the tubing string 200 while the control pin 38 is in the set slot 236, an operator can rotate the tubing string 200 to the left or counterclockwise, as viewed from above. This causes the control pin 38 to travel through passage slot 244 to the RH set/LH release run slot 240, where the tool assembly 10 is held in a neutral or released condition.

In operations when the control pin 38 is initially in the RH set/LH release run slot 240, as the tool assembly 10 is run into the well casing, the control pin 38 will abut and push against the bottom end 246 of the shorter RH set/LH release run slot 240, as shown in FIG. 20. In this position, the tool assembly 10 is in a neutral condition where the slip assemblies 110A, 110B are out of engagement with the well casing 204.

With the control pin 38 at the bottom end 246 of run slot 240, when the tubing string and tool assembly 10 employing control body 230 are run into and positioned in the well casing 204 at the depth where it is to be set and it is desired to anchor the tubing string, slight upward tension is placed on the tubing string 200. This acts on the mandrel 12 and causes the control pin 38 to ride upward in the run slot 240 to its upper end 248. Once at this position, the tubing string 200 is rotated to the right or clockwise (as viewed from above) and the upward tension on the tubing string 200 is released. This causes the tubing string 200 and mandrel 12 to drop, with the control pin 38 traveling through the passage slot 244 and into set slot 236 where the control pin 38 drops to a lower position 250 within set slot 236 below the run slots 238, 240 where the tool assembly 10 is moved to and maintained in a stationary, caught condition.

Once the control pin 38 is in the set slot 236, the tubing string 200 can be lifted so that the control pin 38 is moved to an upper position 252, which is located above the run slots 238, 240. This movement causes the tubing string 200 and anchor tool 10 to be moved to and maintained in stationary, anchored condition.

To release the tool assembly 10 employing the control body 230 with the control pin 38 in the set slot 236, a right-hand (RH) or left-hand (LH) release may be used wherein the tubing string 200 is rotated to the right (i.e., clockwise) or left (counterclockwise), as viewed from above. This is achieved by releasing upward tension on the tubing string 200 so that the mandrel 12 and the control pin 38 drops to a lower position within the set slot 236. This disengages the tool assembly 10 so that it is in a neutral or released condition. If the tubing string 200 is rotated to the right (clockwise), the control pin 38 will travel from set slot 236 through passage slot 242 and into run slot 238 where tool assembly 10 is maintained in the neutral or released condition to withdraw or reposition the tubing string and tool assembly 10.

Alternatively, if the tubing string is rotated to the left or counterclockwise, the control pin 38 will travel from set slot 236 through passage slot 244 and into run slot 240 where tool assembly 10 is also maintained in the neutral or released condition to withdraw or reposition the tubing string 200 and tool assembly 10.

Thus, in the embodiment of the tool assembly 10 employing the control body 230, the interconnected slots allow for RH set/RH release, LH set/LH release, RH set/LH release, or LH set/RH release. In the embodiment shown, the total amount of rotation of the tubing string 200 and mandrel 12 encounter to move the control pin 38 from one of the run slots 238, 240 to the set slot 236 or vice versa is 750 or less than a quarter (90°) turn.

The various embodiments of the tool assembly described herein have several advantages over those anchoring systems used in the prior art. Unlike conventional anchoring systems that require multiple turns of the tubing string to set and release the anchoring system, the present tool assembly requires very little rotation of the tubing string. Indeed, in all cases, the tubing string will undergo less than 90° or less than a quarter turn of rotation to go from the released to set conditions and vice versa. When going from the released to set condition, the amount of rotation required at the surface is very little, as the tubing string and mandrel will rotate on their own as they drop and the control pin is guided and travels downward from the run slot to the set slot through the interconnected slots.

The tool assembly can be readily used with well casings of different sizes without modification of the tool assembly. Well casings may come in different sizes, such as 14 lbs/ft, 15.5 lbs/ft, 17 lbs/ft, 20 lbs/ft, 23 lbs/ft and 26 lbs/ft. The greater the weight, the thicker the wall of the well casing and the smaller the interior diameter. Thus, with well casings with thicker walls (i.e., smaller inner diameters), the control pin 38 will slide a shorter distance within the set slot of the control bodies when the slip assemblies 110A, 110B fully engage the casing wall. With thinner wall casings (i.e., casings with larger inner diameters), the control pin 38 will locate closer to the ends of the set slot, while still avoiding contact with the ends of the slot. The cones, slip assemblies and set slots of the control bodies of the tool assembly 10 can be configured to facilitate engaging the different size well casings and the length of the set slots can be selected to prevent contact of the control pin 38 with the upper and lower ends of the set slot even when used for different size well casings.

The tool assembly also provides increased fluid flow through both the tubing string and in the annular space between the tool assembly and the interior of the well casing. Conventional tubing anchors, such as those that require multiple turns to set and release the anchoring system typically have an outer diameter of 4.50 inches with no fluid flow bypass passages. In other tubing anchor systems that reduce the outer diameter of the anchoring system, this is typically achieved by reducing the inner diameters of the interior flow passage of the tubing anchors so that the inner diameter of the anchoring system is less than the inner diameter of the tubing string, thus causing a constriction at the anchor tool that limits the flow through the tubing string. Tubing strings typically have an inner diameter of 2.30 inches. In one such system that has reduced exterior dimensions of the anchoring system that is less than 4.50 inches, the decreased outer diameter is provided by decreasing the inner diameter of the anchoring system to approximately 1.9 inches, which is much less than the inner diameter of the tubing itself.

The various embodiments of the tool assembly described herein do not decrease the flow through either the annular space between the tubing string and well casing or through the tubing string itself. This is because the exterior of the tool itself can have a reduced outer diameter without requiring the inner diameter of the interior flow passage to be reduced. In particular embodiments, the outer diameter of the tool assembly can be reduced with a maximum outer diameter of 4.40 inches and the inner diameter central passage 18 of the mandrel 12 of the tubing anchor assembly can be the same or closely match that of the tubing itself, e.g., 2.30 inches. Thus, no decrease in the flow through the tubing string results from the use of the tool assembly.

Additionally, longitudinal interior passages 120 formed as recesses on the interior wall of the slip housing 112 and cutout areas 122 on the exterior of the slip housing 112, as well as grooves or channels 168 and cutouts or flats 176 on the exterior of the cones 158 also facilitate increased fluid flow around the exterior of the tool assembly 10. These features also may produce turbulent fluid flow around the exterior and surfaces of the tool assembly so that minerals and other particles are prevented from being deposited on the surfaces of the tool.

Additionally, in many anchoring systems, the tool itself is configured to latch or lock when it is in a caught or anchored condition. This can present a problem if the latching or locking mechanism becomes stuck so that it is difficult to free. In the embodiments of the present tool assembly, there is no latching or locking when the tool assembly is in the caught or anchored condition. Thus, there is no risk of such latching or locking becoming stuck.

While the invention has been shown in some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

I claim:

1. A tool assembly for anchoring and/or catching well equipment within a well casing, the tool assembly comprising:

an elongated mandrel having a central longitudinal axis and being configured to couple at one end to the well equipment, the mandrel having a cylindrical mandrel wall having at least one non-circumferential raised or projecting area that projects from the mandrel wall;

a control pin stationarily coupled to and projecting radially outward from the exterior of the mandrel;

a control body comprising a control body wall with a central opening that is mounted over the mandrel, the mandrel being movable within the central opening to allow longitudinal and rotational movement of the mandrel relative to the control body, the control body having at least one drag body configured to engage the well casing to provide a degree of resistance to movement of the control body relative to the well casing and/or mandrel;

wherein the mandrel wall is spaced radially inward from the interior of the control body wall along the length of the control body to define an annular space that creates a flow passage adjacent to the at least one raised or projecting area, the at least one raised or projecting area configured to facilitate centering the control body on the mandrel;

at least one cone having a tapered exterior surface that tapers radially inwardly along the length of the cone to a narrow end, the at least one cone being coupled to the mandrel with the narrower end of the cone facing the control body;

a slip assembly associated with the at least one cone comprising a slip housing coupled to one end of the control body that faces the at least one cone and at least one slip body that is carried by the slip housing, the at least one slip body being configured to contact and slide along the tapered exterior surface of the cone so that the at least one slip body is forced radially outward by the cone to facilitate engagement of the slip body with the well casing during anchoring and/or catching of the tool assembly within the well casing when the tool assembly is changed to a set condition, and wherein the slip body is moved away from the at least one cone and retracts radially inward so that the at least one slip body is disengaged from the well casing when the tool assembly is changed to a released condition; and a set of interconnected slots formed in the control body wall of the control body that are configured to receive the control pin, with the control pin traveling within the set of interconnected slots, the interconnected slots comprising a run slot at a first circumferential position of the control body wall, the run slot having a longitudinal length that limits the distance the control pin and mandrel travel longitudinally relative to the control body so that the tool assembly is maintained in the released condition while the control pin resides within the run slot, the interconnected slots further comprising a set slot that is spaced circumferentially apart from the run slot on the control body wall, the run slot and set slot being joined together by a slot passage that allows the control pin to move between the run slot and the set slot when the mandrel is rotated about the central longitudinal axis, and wherein the set slot has a longitudinal length that allows the control pin and mandrel to travel longitudinally relative to the control body to allow the tool assembly to be moved to the set condition.

2. The tool assembly of claim 1, wherein:

there are two spaced apart cones comprising a catcher cone coupled to the mandrel at an upper position and an anchor cone coupled to the mandrel at a lower position, with the control body being positioned on the mandrel between the catcher and anchor cones, the narrow end of each cone facing the control body; and wherein there are two slip assemblies comprising an upper slip assembly and a lower slip assembly, each slip assembly coupled to opposite ends of the control body, the upper slip assembly being associated with the catcher cone and the lower slip assembly being associated with the anchor cone, wherein the at least one slip body of the upper slip assembly is forced radially outward by the catcher cone to facilitate engagement of the at least one slip body with the well casing when the control pin is positioned in the set slot and the mandrel is moved downward in the well casing and so that the tool assembly is set in a caught set condition; and wherein the at least one slip body of the lower slip assembly is forced radially outward by the anchor cone to facilitate engagement of the at least one slip body with the well casing when the control pin is positioned in the set slot and the mandrel is moved upward in the well casing so that the tool assembly is set in an anchored set condition.

3. The tool assembly of claim 2, wherein:

the anchor cone is slidingly coupled to the mandrel through a shear ring assembly against which the anchor cone abuts, the shear ring assembly comprising a shear ring having multiple apertures for receiving shear fasteners and one or more shear fasteners of selected shear ratings, the shear ring being fastened to the mandrel through the one or more shear fasteners, the shear ring assembly being configured to provide a selected degree of shear resistance before shearing by increasing or decreasing the number of shear fasteners, and wherein shearing of the shear ring assembly occurs when the shear resistance of the shear ring assembly is exceeded by sufficient upward force being applied to the mandrel and causing the anchor cone to drop away from the control body.

4. The tool assembly of claim 1, wherein:

the run slot and the set slot are circumferentially spaced apart on the control body wall from 90 degrees or less.

5. The tool assembly of claim 1, wherein:

the run slot and the set slot are circumferentially spaced apart on the control body wall from 75 degrees or less.

6. The tool assembly of claim 1, wherein:

the set of interconnected slots are configured to cause the control pin to travel from the run slot to the set slot by rotating the mandrel in a first rotational direction, and wherein the interconnected slots are configured to cause the control pin to travel from the set slot to the run slot by further rotation of the mandrel in the first rotational direction.

7. The tool assembly of claim 1, wherein:

the set of interconnected slots are configured to cause the control pin to travel from the run slot to the set slot by rotating the mandrel in a first rotational direction, and wherein the interconnected slots are configured to cause the control pin to travel from the set slot to the run slot by rotation of the mandrel in an opposite second rotational direction.

8. The tool assembly of claim 1, wherein:

the set of interconnected slots are configured to cause the control pin to travel from the run slot to the set slot and vice versa by rotating the mandrel in any rotational direction.

9. The tool assembly of claim 1, wherein:

there are two sets of interconnected slots on opposite sides of the control body.

10. The tool assembly of claim 9, wherein:

one of the two sets of interconnected slots are configured to cause the control pin to travel from the run slot to the set slot by rotating the mandrel in a first rotational direction, and wherein the interconnected slots of said one of the two sets of interconnected slots are configured to cause the control pin to travel from the set slot to the run slot by continued rotation of the mandrel in the first rotational direction; and the other of the two sets of interconnected slots is configured to cause the control pin to travel from the run slot to the set slot by rotating the mandrel in a first rotational direction, and wherein the interconnected slots of said other of the two sets of interconnected slots are configured to cause the control pin to travel from the set slot to the run slot by rotation of the mandrel in an opposite second rotational direction.

11. The tool assembly of claim 1, wherein:

the slip housing of the slip assembly has an interior that is provided with interior fluid bypass passages configured to facilitate increased fluid flow through an interior of the slip housing.

12. The tool assembly of claim 1, wherein:

the slip housing of the slip assembly has an exterior that is provided with cutouts configured to increase fluid flow through the well casing around the exterior of the slip housing.

13. The tool assembly of claim 1, wherein:

the at least one cone has one or more grooves formed in an exterior of the cone configured to increase fluid flow through the well casing around the at least one cone.

14. The tool assembly of claim 13, wherein:

at least one of the one or more grooves is set at an angle of from greater than 0° and less than 90° relative to the longitudinal axis of the mandrel.

15. The tool assembly of claim 1, wherein:

the well equipment is a tubing string having a cylindrical, central flow passage with an inner diameter; and wherein the mandrel has a cylindrical, central flow passage having an inner diameter that is not less than the inner diameter of the tubing string.

16. A tool assembly for anchoring and/or catching a tubing string within a well casing, the tool assembly comprising:

an elongated mandrel having a central longitudinal axis and being configured to couple at an upper end to the tubing string, the mandrel having a cylindrical mandrel wall having at least one non-circumferential raised or projecting area that projects from the mandrel wall;

a control pin stationarily coupled to and projecting radially outward from the exterior of the mandrel;

a control body comprising a control body wall with a central opening that is mounted over the mandrel, the mandrel being movable within the central opening to allow longitudinal and rotational movement of the mandrel relative to the control body, the control body have at least one drag body configured to engage the well casing to provide a degree of resistance to movement of the control body relative to the well casing and/or mandrel;

wherein the mandrel wall is spaced radially inward from the interior of the control body wall along the length of the control body to define an annular space that creates a flow passage adjacent to the at least one raised or projecting area, the at least one raised or projecting area configured to facilitate centering the control body on the mandrel;

a pair of spaced apart cones comprising a catcher cone coupled to the mandrel at an upper position and an anchor cone coupled to the mandrel at an opposite lower position, with the control body being positioned on the mandrel between the catcher and anchor cones, each cone having a tapered exterior surface that tapers radially inwardly along the length of the cone to a narrow end, with the narrower end of each cone facing the control body, each cone having one or more grooves formed in an exterior of the cone configured to increase fluid flow through the well casing around the at least one cone;

a pair of slip assemblies comprising an upper slip assembly and a lower slip assembly, each slip assembly coupled to opposite ends of the control body, the upper slip assembly being associated with the catcher cone and the lower slip assembly being associated with the anchor cone, each slip assembly comprising a slip housing coupled to one end of the control body and two or more circumferentially spaced apart slip bodies that are carried by the slip housing, the slip bodies being configured to contact and slide along the tapered exterior surface of one of the cones so that the slip bodies are forced radially outward by the cone to facilitate engagement of the slip bodies with the well casing during anchoring and/or catching of the tool assembly within the well casing when the tool assembly is changed to a set condition, and wherein the slip bodies are moved away from the cone and retract radially inward so that the slip bodies are disengaged from the well casing when the tool assembly is changed to a released condition;

wherein the slip housing of each slip assembly further comprises at least one of: 1) an interior with fluid bypass passages configured to facilitate increased fluid flow through an interior of the slip housing; and 2) an exterior with cutouts configured to increase fluid flow through the well casing around the exterior of the slip housing;

a set of interconnected slots formed in the control body wall of the control body that are configured to receive the control pin, with the control pin traveling within the set of interconnected slots, the interconnected slots comprising a run slot at a first circumferential position of the control body wall, the run slot having a longitudinal length that limits the distance the control pin and mandrel travel longitudinally relative the control body so that the tool assembly is maintained in the released condition while the control pin resides within the run slot, the interconnected slots further comprising a set slot that is spaced circumferentially apart from the run slot on the control body wall from 90° or less, the run slot and set slot being joined together by a slot passage that allows the control pin to move between the run slot and the set slot when the mandrel is rotated about the central longitudinal axis, and wherein the set slot has a longitudinal length that allows the control pin and mandrel to travel longitudinally relative the control body to allow the tool assembly to be moved to the set condition; and wherein the slip bodies of the upper slip assembly are forced radially outward by the catcher cone to facilitate engagement of the slip bodies of the upper slip assembly with the well casing when the control pin is positioned in the set slot and the mandrel is moved downward in the well casing and so that the tool assembly is set in a caught set condition; and wherein the slip bodies of the lower slip assembly are forced radially outward by the anchor cone to facilitate engagement of the slip bodies with the well casing when the control pin is positioned in the set slot and the mandrel is moved upward in the well casing so that the tool assembly is set in an anchored set condition.

17. The tool assembly of claim 16, wherein:

the set of interconnected slots are configured to cause the control pin to travel from the run slot to the set slot by rotating the mandrel in a first rotational direction, and wherein the interconnected slots are configured to cause the control pin to travel from the set slot to the run slot by further rotation of the mandrel in the first rotational direction.

18. The tool assembly of claim 16, wherein:

the set of interconnected slots are configured to cause the control pin to travel from the run slot to the set slot by rotating the mandrel in a first rotational direction, and wherein the interconnected slots are configured to cause the control pin to travel from the set slot to the run slot by rotation of the mandrel in an opposite second rotational direction.

19. The tool assembly of claim 16, wherein:

the set of interconnected slots are configured to cause the control pin to travel from the run slot to the set slot and vice versa by rotating the mandrel in any rotational direction.

20. The tool assembly of claim 16, wherein:

there are two sets of interconnected slots on opposite sides of the control body; and one of the two sets of interconnected slots are configured to cause the control pin to travel from the run slot to the set slot by rotating the mandrel in a first rotational direction, and wherein the interconnected slots of said one of the two sets of interconnected slots are configured to cause the control pin to travel from the set slot to the run slot by continued rotation of the mandrel in the first rotational direction; and the other of the two sets of interconnected slots is configured to cause the control pin to travel from the run slot to the set slot by rotating the mandrel in a first rotational direction, and wherein the interconnected slots of said other of the two sets of interconnected slots are configured to cause the control pin to travel from the set slot to the run slot by rotation of the mandrel in an opposite second rotational direction.

* * * * *